US011761067B2

(12) United States Patent
Li et al.

(10) Patent No.: US 11,761,067 B2
(45) Date of Patent: Sep. 19, 2023

(54) LOW CARBON STEEL HAVING IMPROVED HARDNESS AND METHODS OF MAKING THE SAME

(71) Applicant: The Florida State University Research Foundation, Inc., Tallahassee, FL (US)

(72) Inventors: Huigai Li, Shanghai (CN); Ke Han, Tallahassee, FL (US); Yan Xin, Tallahassee, FL (US); Shaobo Zheng, Shanghai (CN); Liuxing Wang, Shanghai (CN); Qijie Zhai, Shanghai (CN)

(73) Assignee: THE FLORIDA STATE UNIVERSITY RESEARCH FOUNDATION, INC., Tallahassee, FL (US)

( * ) Notice: Subject to any disclaimer, the term of this patent is extended or adjusted under 35 U.S.C. 154(b) by 298 days.

(21) Appl. No.: 16/601,024

(22) Filed: Oct. 14, 2019

(65) Prior Publication Data

US 2020/0149138 A1 May 14, 2020

Related U.S. Application Data

(60) Provisional application No. 62/745,814, filed on Oct. 15, 2018.

(51) Int. Cl.

| | |
|---|---|
| ***C22C 33/06*** | (2006.01) |
| ***C21D 9/46*** | (2006.01) |
| ***C22C 38/14*** | (2006.01) |
| ***C22C 38/04*** | (2006.01) |

(Continued)

(52) U.S. Cl.
CPC ..... *C22C 33/06* (2013.01); *C21D 9/46* (2013.01); *C22C 38/002* (2013.01); *C22C 38/004* (2013.01); *C22C 38/02* (2013.01); *C22C 38/04* (2013.01); *C22C 38/14* (2013.01); *C21D 2211/005* (2013.01); *C21D 2211/008* (2013.01)

(58) Field of Classification Search
None
See application file for complete search history.

(56) References Cited

U.S. PATENT DOCUMENTS

2012/0230800 A1* 9/2012 Kimura ..... C22C 38/04 411/424

OTHER PUBLICATIONS

"Steel Melt Processing." ASM Handbook, vol. 15, pp. 206-229. 2008. (Year: 2008).*

(Continued)

*Primary Examiner* — Brian D Walck
(74) *Attorney, Agent, or Firm* — Eversheds Sutherland (US) LLP

(57) ABSTRACT

Provided herein are techniques for making low-carbon steels with high surface hardness. A technique includes heating a low-carbon steel precursor material in a furnace to form molten steel material, increasing the free oxygen content of the molten steel material to a predetermined level, and then solidifying the molten steel material having the predetermined oxygen level to produce a steel structure by cooling the molten steel material at a predetermined cooling rate. The predetermined oxygen level and the predetermined cooling rate are effective to produce the low-carbon steel with a high surface hardness. The low-carbon steel may have inclusions smaller than about 1 μm.

13 Claims, 18 Drawing Sheets

(51) Int. Cl.
*C22C 38/00* (2006.01)
*C22C 38/02* (2006.01)

(56) References Cited

OTHER PUBLICATIONS

"Conversion between Vickers Hardness Number and SI Units MPa and GPa." https://www.gordonengland.co.uk/xhardness/xhvconv.htm. Accessed Apr. 9, 2022. (Year: 2022).*
Stefanescu et al. "Fundamentals of Solidification." ASM Handbook, vol. 9: Metallography and Microstructures. pp. 71-92. 2004. (Year: 2004).*
Sosinksy, D.J., et al., "The Castrip® Process—Recent Developments at Nucor Steel's Commercial Strip Casting Plant", Metallurgist, Dec. 2008, vol. 52 (11-12), pp. 691-699.
Xiong, Z.P., et al., "Effect of deformation on microstructure and mechanical properties of dual phase steel produced via strip casting simulation", Materials Science & Engineering A, Jan. 2016, vol. 651, pp. 291-305.
Ohta, H., et al., "Effects of Dissolved Oxygen and Size Distribution on Particle Coarsening of Deoxidation Product", Institute for Multidisciplinary Research for Advanced Materials, Jan. 2006, vol. 46(1), pp. 43-49.
Goto, H., et al., "Effect of Cooling Rate on Oxide Precipitation during Solidifcation of Low Carbon Steels", ISIJ International, May 1994, vol. 34, pp. 414-419.
Yu, Han-song, et al., "Size distribution of inclusions in 12%Cr stainless steel with a wide range of solidification cooling rates", International Journal of Minerals, Metallurgy and Materials, Nov. 2015, vol. 22, No. 11, pp. 1157-1162.
Deng, L.Q., et al., "Casting Technology", Foundry Technology, Sep. 2016, vol. 37, No. 9, pp. 1807-1811.
Liu, H.T., et al., "Characterization of the solidifcation structure and texture development of ferritic stainless steel produced by twin-roll strip casting", Materials Characterization, Jan. 2009, vol. 60(1), pp. 79-82.
Sarma, D.S., et al., "On the Role of Non-metallic Inclusions in the Nucleation of Acicular Ferrite in Steels", ISIJ International, Jul. 2009, vol. 49, No. 7, pp. 1063-1074.
Byun, J.-S., et al. "Non-metallic inclusion and intragranular nucleation of ferrite in Ti-killed C-Mn steel", Acta Materialia, Apr. 2003, vol. 51, pp. 1593-1606.
St-Laurent, Sylvain, et al., "Effects of chemistry, density and size distribution of inclusions on the nucleation of acicular ferrite of C-Mn steel shielded-metal-arc-welding weldments", Materials Science Engineering, Jan. 1992, vol. 149(2), pp. 2016-2216.
Mu, W., et al., "Effect of Carbon Content on the Potency of the Intragranular Ferrite Formation", Steel Research International, Mar. 2016, vol. 87(3), pp. 311-319.
Loder, D., et al., "Acicular Ferrite Formation and It's Influencing Factors—A Review", Journal of Materials Science Research, Jan. 2017, vol. 6(1), pp. 24-43.
Xiong, Z.P., et al., "Effect of deformation on microstructure and mechanical properties of dual phase steel produced via strip casting simulation", Materials & Science Engineering A, 2016, vol. 106, pp. 232-239.
Li, Y., et al., "Effect of Zr-Ti combined deoxidation on the microstructure and mechanical properties of high-strength low-alloy steels", Materials Science & Engineering A, Jan. 2016, vol. 659, pp. 179-187.
Zhang, Z. et al., "Role of non-metallic inclusions in formation of acicular ferrite in low alloy weld metals", Materials Science & Technology, Mar. 1996, vol. 12(3), pp. 237-260.
Kim, B. et al., "Effects of Inclusions and Microstructures on Impact Energy of High Heat-Input Submerged-Arc-Weld Metals", Journal of Engineering Materials & Technology, Apr. 2005, vol. 127(2), pp. 204-213.
Shrestha, S. et al., "Cluster strengthening of Nb-microalloyed ultra-thin cast strip steels produced by the CASTRIP® process", Materials Science & Engineering A, Apr. 2013, vol. 568, pp. 88-95.
Wang, Z., et al., "The effect of cooling rate and coiling temperature on the niobium retention in Ultra-Thin Cast Strip steel", Materials Science & Engineering A, Jul. 2017, vol. 700, pp. 234-240.
Costin, W., et al., "A study on the relationship between microstructure and mechanical properties of acicular ferrite and upper bainite", Materials Science & Engineering A, Apr. 2016, vol. 663, pp. 193-203.
Hall, E. O., "The Defomration and Ageing of Mild Steel: III Discussion of Results", Proceedings of the Physical Society, Section B, Mar. 1951, vol. 64(9), pp. 747-753.
Huang, H., et al., "Effect of Milling Time on the Microstructure and Tensile Properties of Ultrafine Grained Ni-SiC Composites at Room Temperature", Journal of Materials Science & Technology, Sep. 2015, vol. 31(9), pp. 923-929.
Ge, Sa, et al., "Progress in Strip Casting Technologies for Steel; Technical Developments", ISIJ International, May 2013, vol. 53, No. 5, pp. 729-452.

* cited by examiner

LOW CARBON STEEL HAVING IMPROVED HARDNESS AND METHODS OF MAKING THE SAME

CROSS-REFERENCE TO RELATED APPLICATIONS

This application claims the benefit of U.S. Provisional Patent Application No. 62/745,814, filed Oct. 15, 2018, which is incorporated herein by reference in its entirety.

STATEMENT REGARDING FEDERALLY SPONSORED RESEARCH AND DEVELOPMENT

This invention was made with government support under Grant No. NSF DMR-1157490 and DMR-1644779 awarded by the National Science Foundation. The government has certain rights in the invention.

BACKGROUND

Technical Field

The present disclosure is generally related to the field of metallurgy and metals processing, and more particularly to techniques for making low-carbon steels and steel materials produced thereby.

Description of the Related Art

Low-carbon steels, which are commonly used in machinery and engineering, such as automotive body panels, are generally considered valuable for their high toughness and ductility, but their hardness and strength are relatively low. In general, the strength and hardness of low-carbon steel varies according to: 1) the alloy content of the steel matrix, 2) the degree of reduction that occurs during hot-rolling, 3) the temperature during coiling, and 4) the duration/degree of heat treatment. Yield strength can vary from 325 MPa to 666 MPa (with alloying addition to enhance the hardenability), and the Vickers hardness values can reach as high as 263 Hv in some cases. However, in low-carbon weld steel composed of acicular ferrite (herein referred to as "AF"), the average Vickers hardness value can be 317 Hv. To enhance the surface hardness and maintain high toughness, a surface treatment may be included in the steel production process. Such surface treatment, however, may increase the complexity of the process and add to the production cost. High hardness may also be achieved in some low-carbon steels by quenching. Without being bound by theory, quenching converts austenite phase into martensite, which has Vickers hardness values up to 300 Hv in plain carbon steels with carbon content up to 0.1%. The combination of alloy addition and a quenching process may produce Vickers hardness values up to 350 Hv and 440 Hv. Unfortunately, achieving these high hardness values in the low-carbon steels with these conventional approaches requires an unnecessarily complex processing procedure and results in reduced toughness and ductility in the end product. Accordingly, it would be desirable to provide improved methods of producing low-carbon steels with ultra-high hardness using methods that mitigate or eliminate one or more of the foregoing disadvantages. It would also be desirable to provide improved carbon steels, for example, that have ultra-high hardness without sacrificing toughness and ductility.

SUMMARY

Provided herein are techniques for making low-carbon steels. The low-carbon steels may have a high surface hardness. For example, a surface region of a low-carbon steel according to the disclosure may have a hardness of at least 4.0 GPa Vickers.

In embodiments, the present disclosure describes a technique for making a low-carbon steel which includes heating a low-carbon steel precursor material in a furnace to form molten steel material. The technique includes increasing the free oxygen content of the molten steel material to a predetermined level. The technique includes, after increasing the free oxygen content, solidifying the molten steel material having the predetermined oxygen level to produce a steel structure by cooling the molten steel material at a predetermined cooling rate. The predetermined oxygen level and the predetermined cooling rate are effective to produce the low-carbon steel with a surface hardness of at least 4.0 GPa Vickers.

In embodiments, the present disclosure describes a technique for making a steel structure which includes heating a low-carbon steel precursor material in a furnace to form molten steel material. The technique includes adding FeO to the molten steel material in an amount effective to produce a predetermined level of free oxygen content. The technique includes adding one or more of FeTi, FeMn, or FeSi to the molten steel material in an amount effective to produce a predetermined density of nucleation sites for acicular ferrite. The technique includes, after adding the FeO and after adding one or more of FeTi, FeMn, or FeSi, solidifying the molten steel to produce the steel structure by cooling the molten steel at a predetermined cooling rate effective to produce inclusions smaller than about 1 μm.

Also provided herein are steel materials, articles, and structures having a high surface hardness.

Figure 1A:
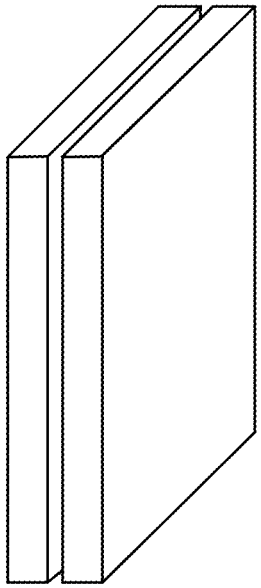
FIG. 1A is a conceptual diagram illustrating a cooling assembly used to prepare sample sheets from molten metal.

It is to be understood that the invention is not limited in its application to the details of construction and the arrangement of components illustrated in the drawings or set forth in the following description.

DETAILED DESCRIPTION

Improved steels and steel production methods have been developed. In particular, it has been discovered how to engineer inclusions in low carbon steels to provide improved materials properties.

The distribution of oxide inclusions depends on the interaction between two variables: Free oxygen content before solidification and cooling rate during solidification. Higher free oxygen content in molten steel results in a low density of large, coarse oxides. Rapid cooling rate during solidification, on the other hand, results in greater undercooling, which provides a greater driving force for nucleation, thus increasing the density of fine oxides. When these two variables are properly balanced, the result is an even distribution of fine oxides throughout the steel.

Oxide inclusions in steel are usually considered defects because, under most circumstances, the presence of inclusions causes cracking simply by interrupting the continuity of the underlying grain structure of steel. Thus, oxygen content in steel is usually kept very low to avoid inclusions. Over time, however, metallurgists have discovered that the hardness of steel can actually be improved by certain types of inclusions. Consequently, designers of new steels may choose to introduce a higher initial oxygen content into the melt. They then manage the resulting oxide inclusions to ensure that these are very fine, dense, and evenly distributed. This occurs when steel solidifies rapidly, at cooling rates as high as, for example, 102-103K/s. Rapid cooling rates force large numbers of oxide inclusions to nucleate simultaneously, only to be immediately trapped, while they are still small, in the rapidly advancing solid/liquid interface, thus enhancing hardness without causing cracking.

Abbreviations used to describe ferrite and martensite morphologies are described. PF, polygonal ferrite, refers to roughly equiaxed grains with straight boundaries and no substructure. Q-PF, quasi-polygonal ferrite, refers to grains with undulating boundaries, which might cross prior austenite boundaries containing a sub-structure. AF, acicular ferrite, refers to a microstructure with high-angle boundaries and randomly oriented needle-shaped lenticular plates. MF, martensite-like ferrite, has ultrafine grains with microstructure similar to that of martensite, which is known to have high hardness.

Under certain circumstances, these fine inclusions can serve as nucleation sites for the formation of acicular ferrite (AF). If fine inclusions are not available, ferrite will instead nucleate on grain boundaries, producing polygonal ferrite (PF) or quasi-polygonal ferrite (Q-PF). AF, on the other hand, is a phase involving needle-shaped grains in a chaotic arrangement that significantly increases the hardness and strength of steel, unlike either PF or Q-PF, which have no such effect.

Oxide inclusions, regardless of their number and density, vary also in composition. It has been reported that Ti-containing inclusions, such as $MnTiO_3$, $Ti_2O_3$, and Ti—Mn—Si—O—S complex inclusions, provide much better sites for AF nucleation than Al-containing inclusions, for example. The critical size for heterogeneous nuclei of AF varies from 0.3 μm to 7 μm, depending on the composition of oxide inclusions and the carbon content of the steel matrix. When the number of Ti-containing inclusions increases, the amount of AF increases correspondingly.

In embodiments, the present disclosure describes techniques of making a low-carbon steel including using a single-step Direct-Cast Hardening (DiCH) method in which free oxygen content in the liquid steel is controlled before solidification, and the cooling rate is controlled during solidification, the controlled oxygen content and cooling rate being effective to produce a low-carbon steel with a high surface hardness.

Also provided herein are steel materials, articles, and structures having a high surface hardness. Steel materials prepared according to the techniques described in the present disclosure may exhibit a relatively high surface hardness while remaining low-carbon steels. The surface hardness may be imparted by controlling one or both of free oxygen content of molten steel solidified to form steel structures, and the cooling rate used to solidify the molten steel.

In some embodiments, the optimum size, number, and distribution of oxide inclusions are achieved by applying a high cooling rate, e.g., greater than 400 K/s, to a material held at intermediate levels of oxygen content, e.g., 25-45 ppm. The resulting ultrahigh hardness produced in the steel may be attributable to the formation of a mixture of AF and ultra-fine lath-structured grains.

By a combination of engineering the inclusion distribution and controlling the cooling rate, ultra-hard, low-carbon steel can be produced using a Direct-Cast Hardening (DiCH) technique. The steel has the same toughness and ductility of other steels produced using the ordinary process, and it has much higher surface hardness. Using DiCH, the Vickers hardness of the surface zone can reach twice as high as that of the interior of the material. For example, an interior of the material may have a hardness of about 2.0 GPa Vickers, while a surface region of the material nay have a hardness of at least about 4.0 GPa Vickers. Surface examination of steels produced in this way may indicate no embrittlement at the hardened region. Techniques according to the disclosure may advantageously avoid the expense of such extra processing as alloying, hot-rolling, cold-rolling, heat treatment, and surface treatment.

In embodiments, the present disclosure describes a technique for making a low-carbon steel includes heating a low-carbon steel precursor material in a furnace to form molten steel material. Any suitable furnace may be used, and any suitable apparatus for heating the precursor material may be used. The precursor material may include any suitable composition, for example, a composition including Fe, C, and other alloying components. Additional components may be added before, during, or after melting. For example, the technique may further include adding to the molten steel material one or more of a Ferromanganese (FeMn) alloy, a Si Ferrosilicon (FeSi) alloy, or a Si Ferrosilicon (FeSi) alloy. In some examples, a steel is used as the precursor material. For example, the low-carbon steel precursor material may include TG30 steel. Thus, a steel material may be used as a precursor, melted, and the free oxygen content of such molten steel controlled followed by cooling to generate another steel material with a hardened surface.

In some embodiments, the technique includes increasing the free oxygen content of the molten steel material to a predetermined level. The free oxygen content may be selected to promote the formation of one or both of AF or MF. In some embodiments, the free oxygen content is controlled to be about 25 to 45 ppm in the molten steel. In some embodiments, the free oxygen content is controlled by adding one or more components before, during, or after the melting, but before solidification. For example, increasing the free oxygen content may include adding FeO to the molten steel material. In some embodiments, the FeO is added in an amount effective to increase the free oxygen content from approximately 25 ppm to 50 ppm.

The technique includes, after increasing the free oxygen content, solidifying the molten steel material having the predetermined oxygen level to produce a steel structure by cooling the molten steel material at a predetermined cooling rate. The predetermined oxygen level and the predetermined cooling rate are effective to produce the low-carbon steel with a high surface hardness. In some embodiments, the surface hardness is at least 4.0 GPa Vickers. In some embodiments, the low-carbon steel has a surface hardness of at least 4.2 GPa Vickers.

Without being bound by theory, the formation of one or both of AF and MF may promote hardness. In some embodiments, the low-carbon steel has a surface having a mixture of refined AF and MF.

The cooling rate may be selected to promote the formation of one or both of AF or MF. For example, in some embodiments, the predetermined cooling rate is greater than or equal to 150 K/s. In some embodiments, the predetermined cooling rate is greater than or equal to 550 K/s. In some embodiments, the predetermined cooling rate is between 500 K/s and 2500 K/s.

The steel material may include inclusions, for example, oxide inclusions, that service as nucleation sites for the formation of AF. In some embodiments, the low-carbon steel includes inclusions smaller than about 1 μm. In some embodiments, the inclusions have sizes in a range from 0.5 to 0.7 μm. In some embodiments, the inclusions include Ti. For example, the inclusions may include multiple-component, Ti-containing oxides.

The inclusions may be distributed in the steel with an area density. For example, the inclusions may be present in the low-carbon steel in an area density up to 600 per $mm^2$.

In embodiments, the present disclosure describes a technique for making a steel structure includes heating a low-carbon steel precursor material in a furnace to form molten steel material. The technique includes adding FeO to the molten steel material in an amount effective to produce a predetermined level of free oxygen content. The technique includes adding one or more of FeTi, FeMn, or FeSi to the molten steel material in an amount effective to produce a predetermined density of nucleation sites for acicular ferrite. The technique includes, after adding the FeO and after adding one or more of FeTi, FeMn, or FeSi, solidifying the molten steel to produce the steel structure by cooling the molten steel at a predetermined cooling rate effective to produce inclusions smaller than about 1 μm.

The technique may be further modified as discussed elsewhere in the disclosure. For example, the predetermined cooling rate may be greater than 150 K/s. In some embodiments, the predetermined cooling rate may be greater than 550 K/s. The predetermined free oxygen content may be in a range of about 25 ppm to about 45 ppm.

The steel structure formed by techniques according to the disclosure may have any suitable shape or form. In some embodiments, the steel structure is a sheet. In some embodiments, the ultrahard surface region is in the form of a layer. For example, the steel structure may include an ultrahard surface layer.

In some embodiments, the surface region may extend to a depth of up to $1/4^{th}$ the thickness of the sheet or material, or an intermediate depth, such as up to, $1/6^{th}$, $1/8^{th}$, or $1/10^{th}$ of the thickness of the sheet or material.

Without being bound by theory, inclusions may remain smaller than 1 μm when the cooling rate is higher than 150 K/s. The distribution of inclusions may be relatively uniform when free oxygen content is in the range of 25-45 ppm and cooling rate is higher than 550 K/s. Multi-component, Ti-containing oxides in the size range of 0.5-0.7 μm may serve as nucleation sites for AF. A high percentage of AF may be formed when the density of the inclusions in this size range increased to 600/$mm^2$.

In materials including some MF along with a large amount of AF, both ductility and hardness may reach high values. For example, the ultimate tensile strength may be 370±14 MPa. Vickers hardness at 200 μm from the surface of a sample reached 4.2 GPa, about 2 times as high as materials including mainly PF and Q-PF.

Thus, a single-step DiCH method for making property-gradient low-carbon steels may be used in which the casting process itself makes the materials directly from the liquid metals, without any post-casting steps required. Such techniques may produce materials with high ductility and with an ultra-hard layer at the surface.

EXAMPLES

Ultra-hard low-carbon steel was produced through DiCH and compared to similar low-carbon steel of ordinary hardness. Three free oxygen levels (low, medium, and high) were used in the smelting process. Manganese, silicon, and titanium were added to the melt to form oxide inclusions. Two parameters were controlled: free oxygen content and cooling rate.

Ultra-hard low-carbon steels usually need many processing steps after casting. However, in this example, a single-step Direct-Cast Hardening (DiCH) method was used to make ultra-hard, low-carbon steels by manipulating two variables: Free oxygen content before solidification and cooling rate during solidification. Without any post-casting steps required to enhance hardness, DiCH produced property-gradient steel with high surface hardness (4.2 GPa Vickers) directly from the liquid metal. The optimum size, number, and distribution of oxide inclusions were achieved in condition of intermediate oxygen content (25-45 ppm) and high cooling rate (≥550 K/s). Ultra-high hardness was achieved at the surface of DiCH samples with a mixture of refined acicular ferrite (AF) and martensite-like ferrite (MF). Two factors contributed to refinement of microstructure and enhancement of hardness: a high cooling rate during the solidification process, and a high density of submicron oxide inclusions in the cast steel. At cooling rates higher than 2500

K/s, refined AF and MF was obtained, accompanied by high densities (up to 600/mm$^2$) of multiple-component, Ti-containing oxides of sizes from 0.5 to 0.7 μm.

Material Preparation

Four samples (S1-S4) were prepared in the following manner. First, three separate batches (B1-B3) of 5.81 kg TG30 steel were heated to 1600° C. in an induction furnace under 200 Pa air pressure. FeO was then added in order to raise the free oxygen content ([O]s) in each batch to one of three levels: approximately 80 ppm for B1, approximately 25 ppm for B2, and approximately 40 ppm for B3. The temperature and [O]s were measured by a Heraeus high-precision disposable immersion sensor with an error of ±5° C.

The first batch (B1) was subjected to sequential addition of 20 g of 80 wt. % Mn Ferromanganese (FeMn) alloy and 6 g of 75 wt. % Si Ferrosilicon (FeSi) alloy. This batch was used to produce S1.

The second batch (B2) was subjected to a more complicated procedure. First, 57 g of FeMn and 19 g of FeSi were added sequentially. Following that, some of this melt was suctioned off and used to make S2. Then 4 g of 40 wt. % Ti Ferrotitanium (FeTi) (with an effective yield of 80%) alloy was added to the remaining melt, and this part was used to make S3.

The third batch (B3) was subjected to sequential addition of the following elements: 4 g of FeTi, 57 g of FeMn, and 19 g of FeSi. This batch was used to produce S4.

Each of the four samples was prepared by suctioning the melt into a volume between two copper plates, as shown in FIG. 1A. FIG. 1A is a conceptual diagram illustrating a cooling assembly used to prepare sample sheets from molten metal. The copper sheets in the assembly of FIG. 1A were separated by 2.5 mm. Each pair of plates had been milled to the specifications necessary to produce the appropriate cooling rate for the sample. The copper plates each were 5-9 mm thick. Thickness was different for different cooling rates.

Figure 1B:
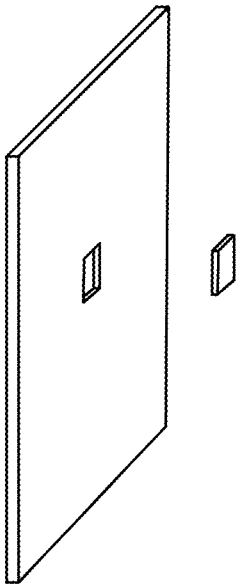
FIG. 1B is a conceptual diagram illustrating a sample sheet prepared using the assembly of FIG. 1A and a piece thereof.
Figure 1C:
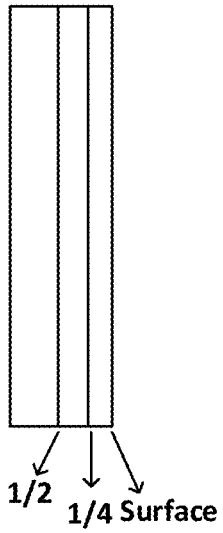
FIG. 1C is a conceptual diagram showing a side view of the piece of the sample of FIG. 1B.

FIG. 1B is a conceptual diagram illustrating a sample sheet prepared using the assembly of FIG. 1A and a piece thereof. The strip sample of 2.5 mm thick was formed in the space between the copper plates. FIG. 1C is a conceptual diagram showing a side view of the piece of the sample of FIG. 1B. As seen in FIG. 1C, the cross-section of the sample has three study zones indicated by arrows, a surface region, a ¼$^{th}$ depth, and ½ depth.

After hardening, the percent weight of major elements in the sample (Si, Mn, and Ti) was analyzed using an optical emission spectrometer (PMI-MASTER) with an error of ±0.01 wt %. Sample compositions are listed in TABLE 1 below.

TABLE 1

Chemical Composition of Each Sample (wt. %)

| Sample | $[O]_s$ | Si | Mn | Ti | C | Fe |
|---|---|---|---|---|---|---|
| S1 | 0.0068 | 0.08 | 0.28 | <0.002 | 0.03 | balance |
| S2 | 0.0028 | | | | | |
| S3 | 0.0011 | 0.25 | 0.78 | 0.02 | | |
| S4 | 0.0037 | | | | | |

Cooling Rate Calculation

Cooling rate varies with the thickness of the copper plates forming the mold—the thicker the plates, the higher the rate. More importantly, however, the cooling rate slows considerably from surface to center within the sample. The cooling rate within the sample strongly affects the segregation of oxygen and thus the distribution of inclusions. Plate thickness, on the other hand, strongly affects the total number of inclusions but not necessarily their distribution.

Figure 2A:
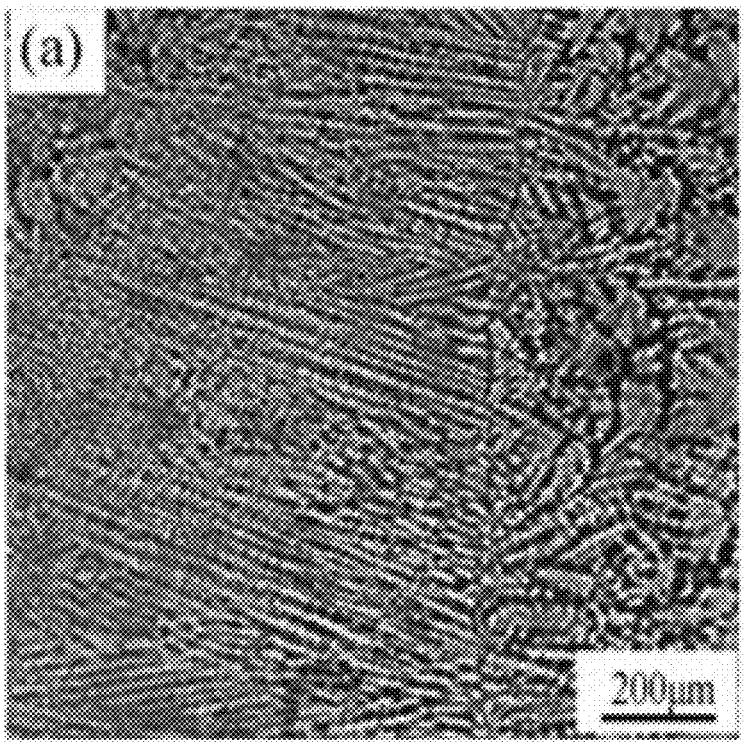
FIG. 2A is a light microscopy photograph showing the dendrite structure of a sample steel material.
Figure 2B:
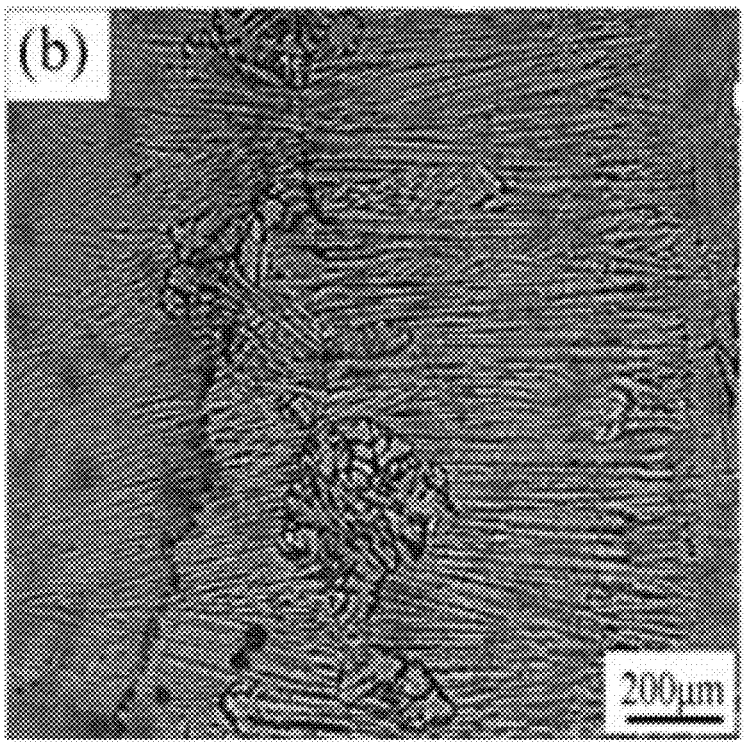
FIG. 2B is a light microscopy photograph showing the dendrite structure of another sample steel material.

The average cooling rate during phase transformation was calculated based on secondary dendrite arm spacing, measured separately in each sample, as shown in FIGS. 2A and 2B. FIG. 2A shows the dendrite structure of a sample steel material. FIG. 2B shows the dendrite structure of another sample steel material. FIG. 2A shows the dendrite structure of S1. FIG. 2B shows the dendrite structure of S4.

For this calculation, strips measuring 10×5×2.5 mm$^3$ were cut from the sample, polished, and thermal etched in supersaturated glacial acetic acid solution. They were then examined using a DM6000M light microscope. From 15 images, which were taken from 15 different areas, secondary dendrite arm spacing was measured by a truncation method at the ¼ depth of each sample. Each area was measured between three and five times. The average values were calculated using all these data. The cooling rate was calculated by the secondary dendrite arm spacing using EQUATION 1.

$$D=688(60\times R)-0.36 \quad \text{(Equation 1)}$$

R is the cooling rate in K/s and d is the secondary dendrite arm spacing in μm.

The average cooling rates at the ¼ depth of S1, S2, S3, and S4 were 1200 K/s, 550 K/s, 150 K/s, and 2500 K/s, respectively, which were considered to be the cooling rates of the four samples in the following sections.

Stress Tests

Changes in cooling rate through the cross-section of the samples affects the size and density of inclusions in various locations. Consequently, the characterization of inclusions must be based on images taken from at least three zones at the edge of the sample: one at the surface, another at ¼ depth, and a third at ½ depth (as shown in FIG. 1C). In this study, each of the target zones was 200 μm wide. Samples that had previously been etched in 3% nital solution were imaged by a Scanning Electron Microscope (SEM, Hitachi SU1510/JSM-6700F). The number of inclusions were counted in 75 images, which had been taken continuously from each of the three zones. The chemical composition of inclusions was measured using the Energy Dispersive Spectrometer (EDS). The density of inclusions was calculated using EQUATION 2.

$$NA=n/s \quad \text{(Equation 2)}$$

n is the total number of detected inclusions, and s is the statistical area.

Vickers hardness tests were performed on all samples using a MH-5L microindenter with a load of 50 gf. In S4, which has a large variation in hardness among the three areas (as discussed in the results section), nanoindentation hardness was also measured using a G200 nanoindenter equipped with a Berkovich tip.

In preparation for the nanoindentation test, S4 was submerged in a solution of $HClO_4$ and glacial acetic acid at about −5° C. While submerged, the sample was electropolished at 40V for 15 s. Once the sample was removed from the solution, it was cleaned ultrasonically. The indentation sites that were selected were all in the interiors of grains. The maximum penetration depth was 2000 nm. Six indents were made at each depth. Nanoindentation hardness was determined by analyzing load-displacement (P-h) curves using the Oliver and Pharr method.

Figure 3A:
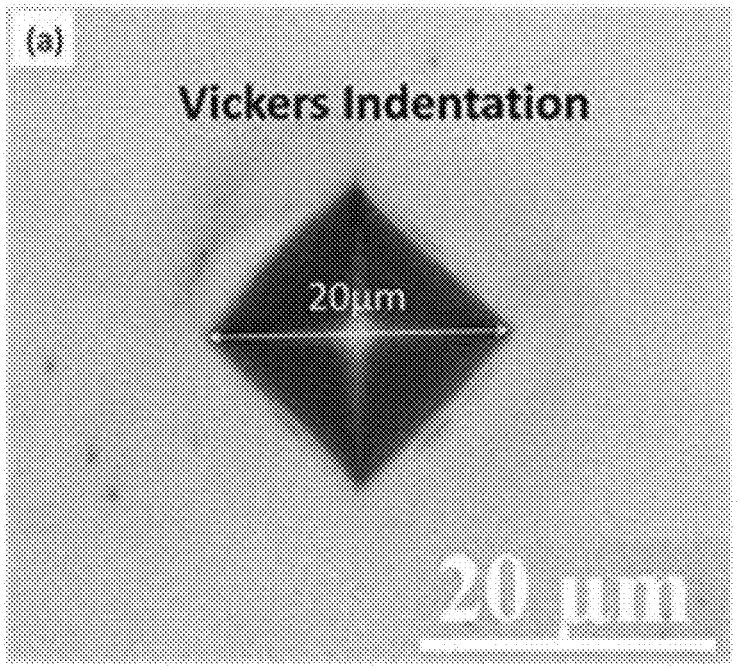
FIG. 3A is a microscopy photograph showing a test Vickers indentation site on a steel sample.
Figure 3B:
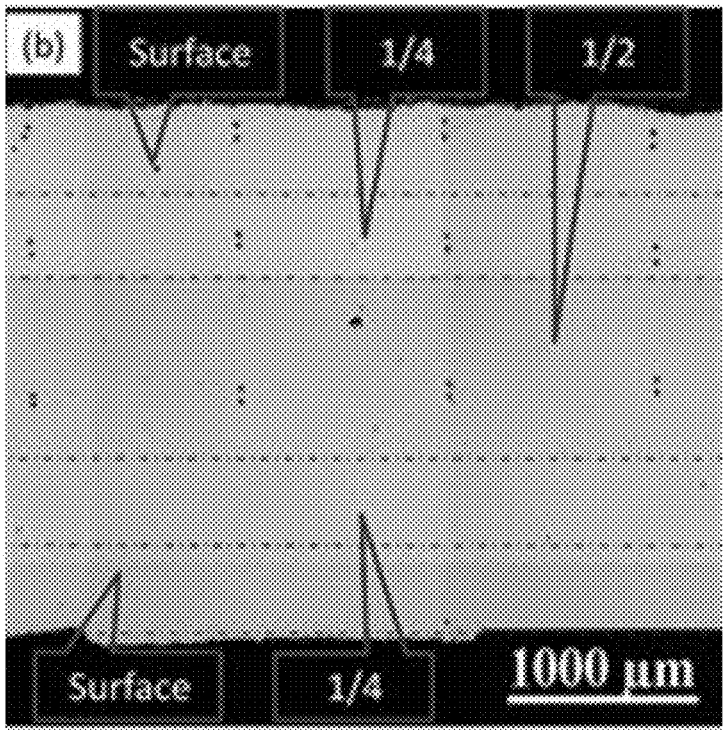
FIG. 3B is a photograph showing test Vickers indentation sites at different locations of a steel sample.

For the Vickers test on all four samples, eight indentations were taken in each zone. FIG. 3A shows a test Vickers indentation site on a steel sample. In some instances, width and depth vary according to the hardness of the steel. FIG. 3B shows test Vickers indentation sites at different locations of a steel sample.

Vickers hardness values were expressed in GPa. Differences in hardness were statistically analyzed according to the T-test. If a P value in a T-Test was smaller than 0.01, the difference in hardness values was considered statistically significant.

Figure 4:
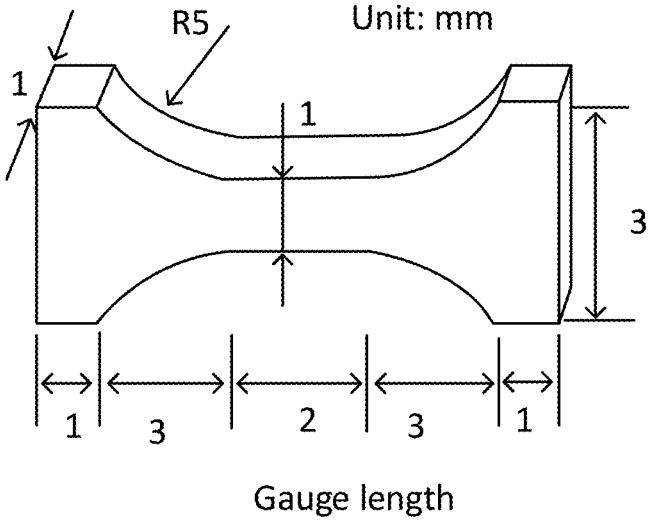
FIG. 4 is a conceptual diagram illustrating the size and shape of a tensile sample.

Sample width was 1 mm and length was 2 mm. FIG. 4 is a conceptual diagram illustrating the size and shape of the tensile sample. Tensile tests were performed on three specimens taken from S4 (the sample with the highest hardness) using an MTS test machine at a rate of 0.12 mm/min. The strain was measured by cross-head reading because of the small specimen size. Stress curve was plotted to show the yield strength and ultimate tensile strength of the specimens.

Single-Step DiCH Method

A single-step DiCH method was used for making property-gradient low-carbon steels. The steels were made by casting to make the materials directly from the liquid metals, without any post-casting steps required. This DiCH method produced materials with very high ductility and with an ultra-hard layer at the surface. Desirable material properties were achieved by manipulating two variables: 1) free oxygen content before solidification, and 2) cooling rate during solidification.

The density of inclusions is influenced by both free oxygen content and cooling rate. As the solid/liquid interface advances from surface to center, free oxygen is forced to concentrate in the remaining zones. This concentration leads to the segregation of oxide inclusions in the center (½ depth). As cooling rate decreases from surface to ½ depth, nucleation rate also decreases. In other words, the remaining oxide at ½ depth is segregated into inclusions that, compared with the surface, are larger in size but fewer in number.

To describe the distribution of oxide inclusions, we devised the term "particle density variation" (PDV), which is related to both free oxygen content ([O]s) and cooling rate according to the EQUATION 3.

$$PDV=(PDC-PDS)/PDC \quad \text{(Equation 3)}$$

PDC is Particle Density at Center, i.e. ½ depth, and PDS is Particle Density at Surface.

Figure 5A:
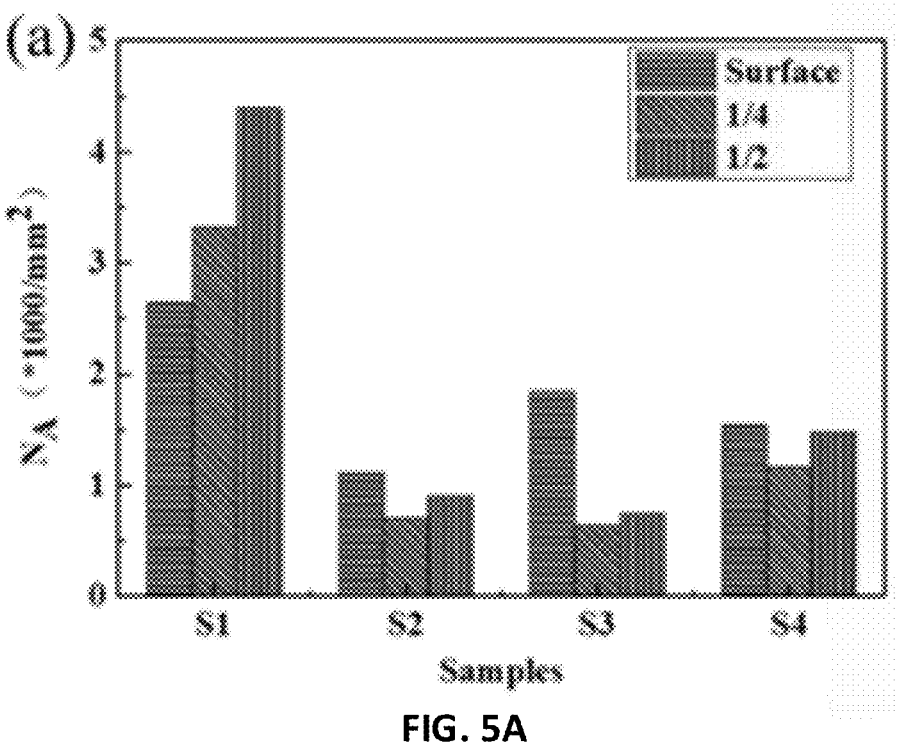
FIG. 5A is a chart illustrating particle density variation for four steel samples.
Figure 5B:
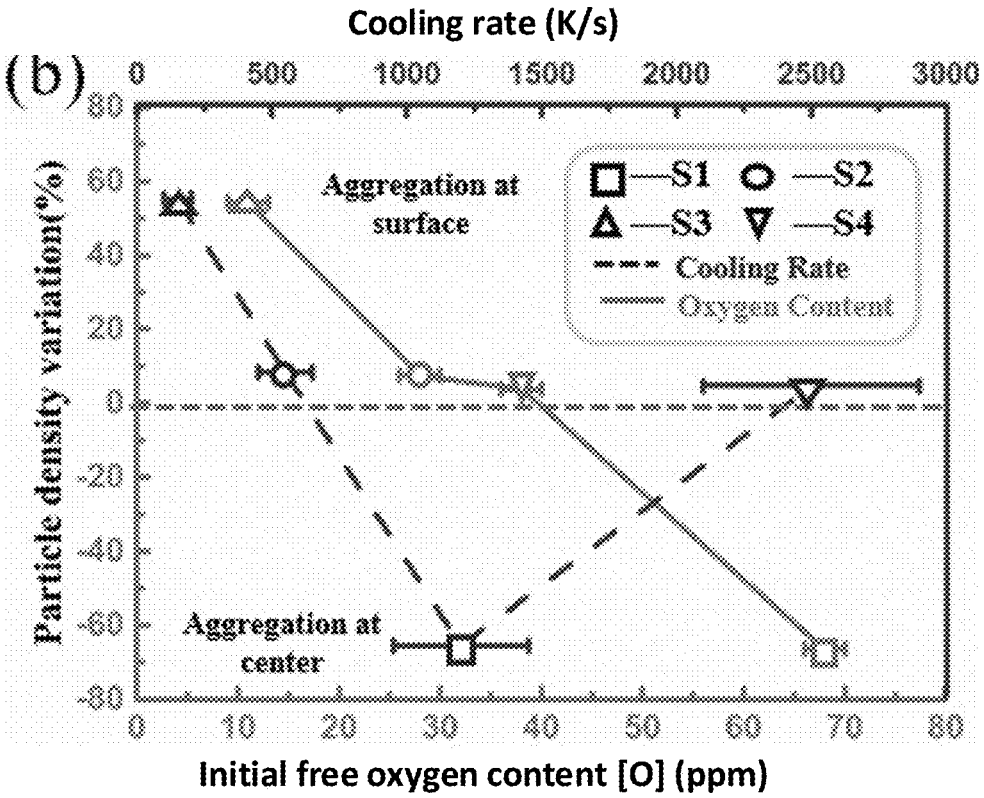
FIG. 5B is a chart illustrating the effect of free oxygen content and cooling rate on inclusion distribution in the four samples.

FIG. 5A is a chart illustrating particle density variation for four steel samples. FIG. 5B is a chart illustrating the effect of free oxygen content and cooling rate on inclusion distribution in the four samples.

When [O]s is in the range of 25-45 ppm and the cooling rate is higher than 550 K/s, the PDV is near zero and the distribution of inclusions is relatively uniform (e.g., as shown in FIGS. 5A and 5B). Particle density and particle density variation is displayed for four samples. FIG. 5A shows particle density (number per unit area) at surface, ¼ depth, and ½ depth, and FIG. 5B shows the effects of initial free oxygen content and cooling rate on inclusion distribution. Distribution is uniform when the value for Particle Density Variation (PDV) is near 0. Positive PDV values indicate aggregation of inclusions toward the surface; negative values indicate aggregation toward the center.

Samples S1 and S4 were both subjected to rapid cooling. Normally, such rapid cooling would inhibit excess segregation of oxygen in the center, but the oxygen content in S1, which was higher than in any other sample, actually negated this inhibition. Consequently, S1 had the greatest PDV; that is, the density of inclusions in the center (½ depth) was much higher than in the other two zones (e.g., as shown in FIG. 5A).

In S3, which had the lowest oxygen content and the slowest cooling rate, the PDV was almost as high as in S1, but for the opposite reason. Where oxygen content dominated in S1, resulting in oxide concentration at ½ depth, cooling rate dominated in S3, resulting in oxide concentration at surface. Consequently, neither S1 nor S3 produced even oxide distribution.

In both S2 and S4, the PDV was near zero (indicating an even distribution of oxides), but there is an important distinction to be made. Although both samples had similar oxygen content, the cooling rate of S4 was 4 times that of S2, so fast that the sample solidified within one second. The greater degree of undercooling that accompanied this rapid rate resulted in supersaturation, thus precipitating the simultaneous formation of a large number of very small oxides that were immediately trapped in the advancing solid/liquid interface. The result was an exceptionally high density of minuscule inclusions within a narrow size range. By contrast, the solid/liquid interface in S2, with its mediocre cooling rate, advanced much less rapidly, leaving time for some inclusions to grow larger than others. This resulted in a wide variety of sizes in S2, albeit with the same PDV as S4.

Our low-carbon steel samples contained several morphologies: PF, Q-PF, martensite-like ferrite (MF), and AF. Of these morphologies, strength and hardness are usually highest and higher in steels containing MF and AF, respectively.

Oxide inclusions containing Ti are known to act as nucleation sites for AF. The volume % of AF varies depending on the number and size of those inclusions. The aim of this study is to determine the minimum number and optimum size necessary to achieve a consistently high volume % of AF in as-cast steel.

Using SEM, variations in microstructure along the cross-section from surface to center in order were examined to compare the four samples with respect to distribution of inclusions and morphology of microstructure.

Figures 6A, 6B, 6C:
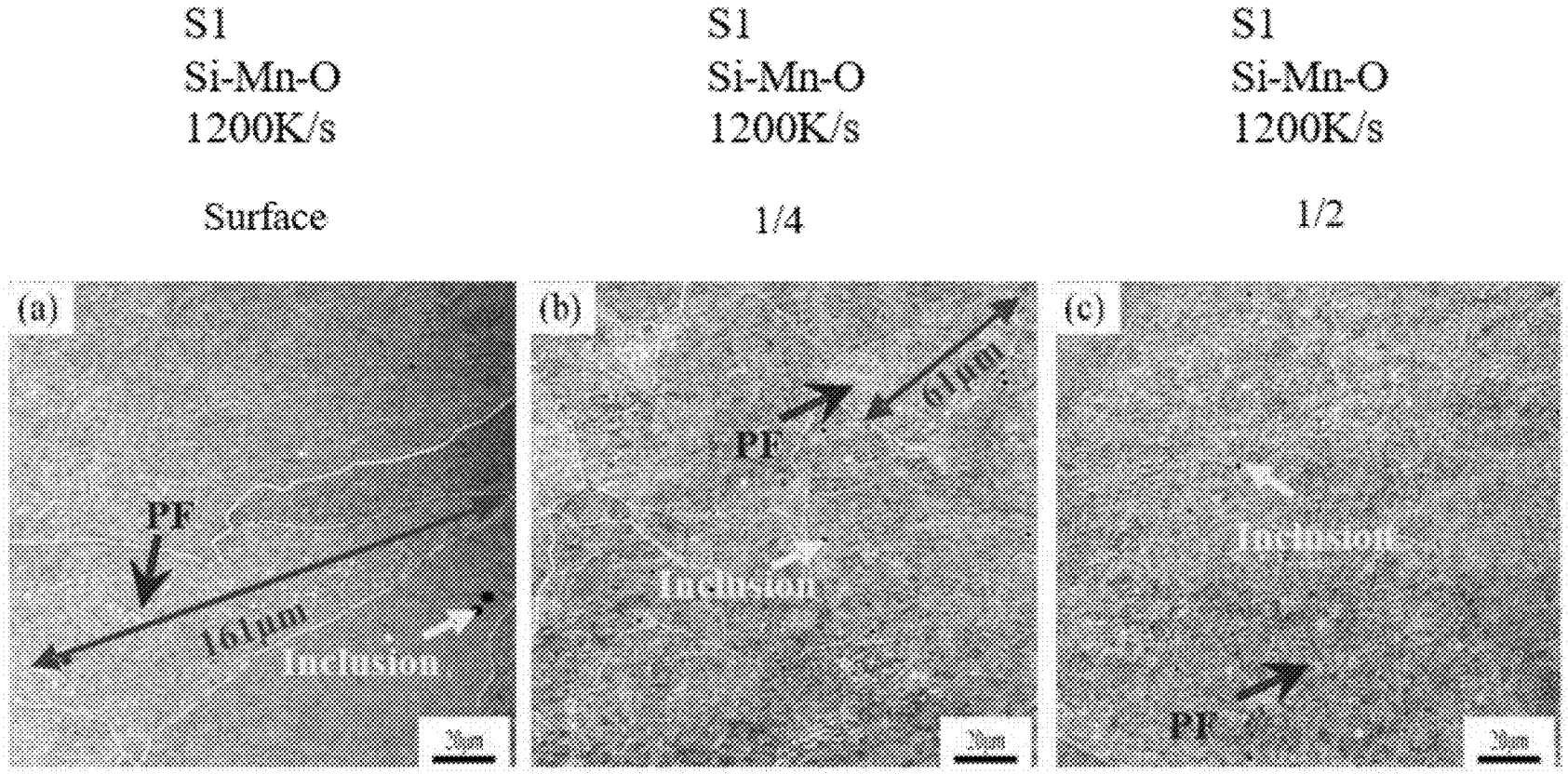
FIGS. 6A, 6B, 6C, 6D, 6E, 6F, 6G, 6H, 6I, 6J, 6K, and 6L are scanning electron microscopy (SEM) images at different sites of the four samples.
Figures 6D, 6E, 6F:
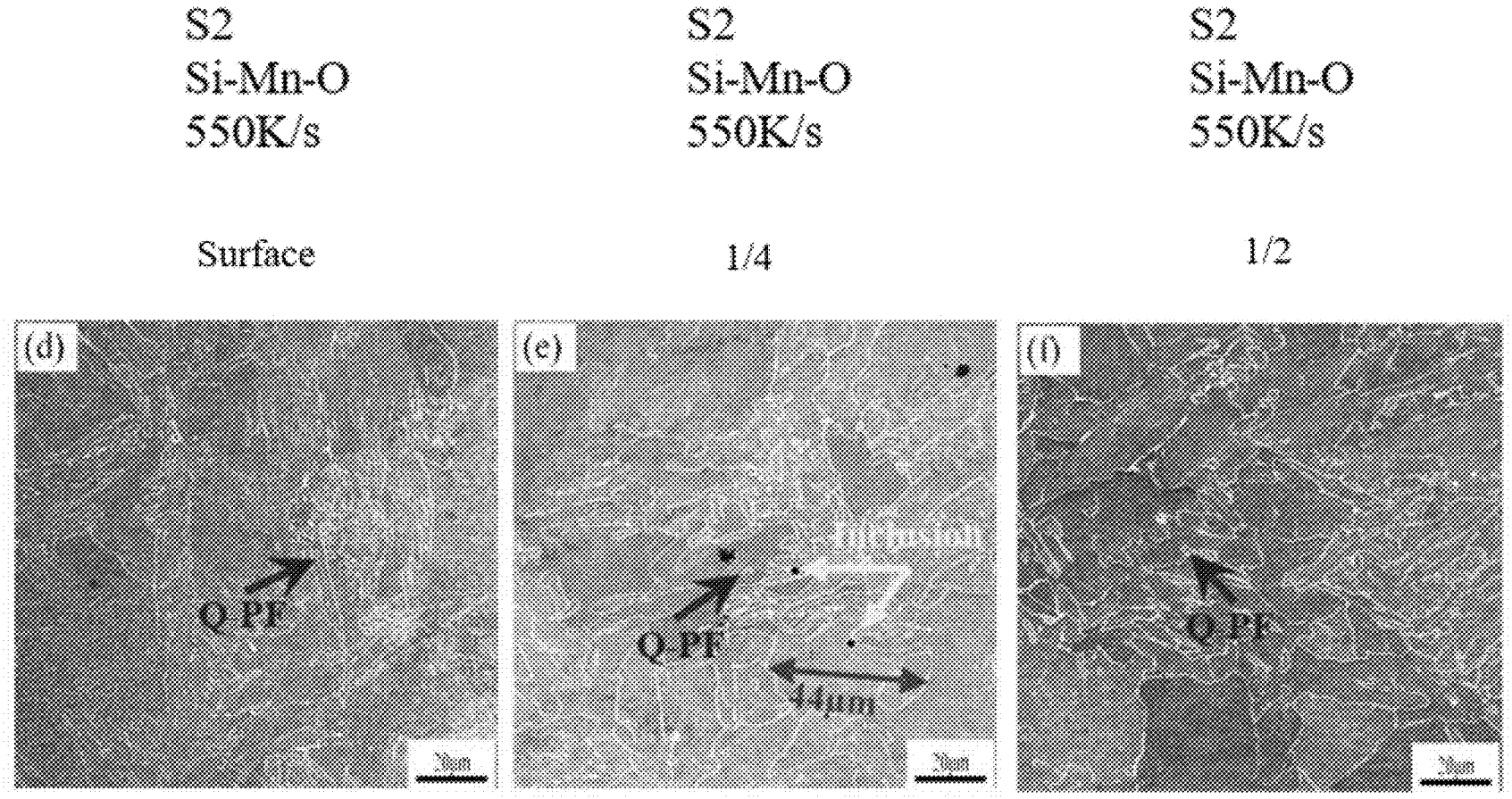
Figure 6I:
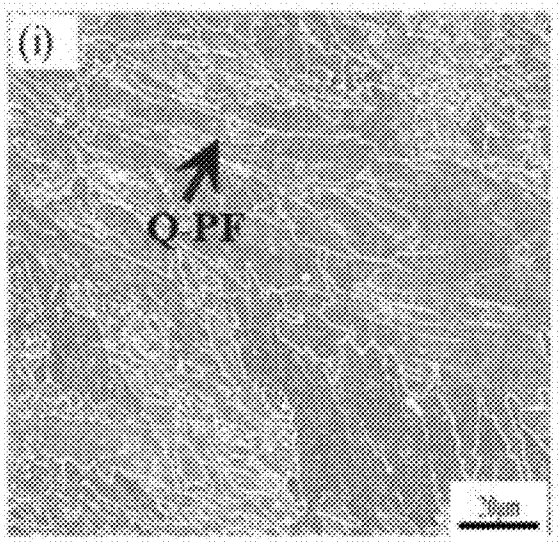
Figure 6H:
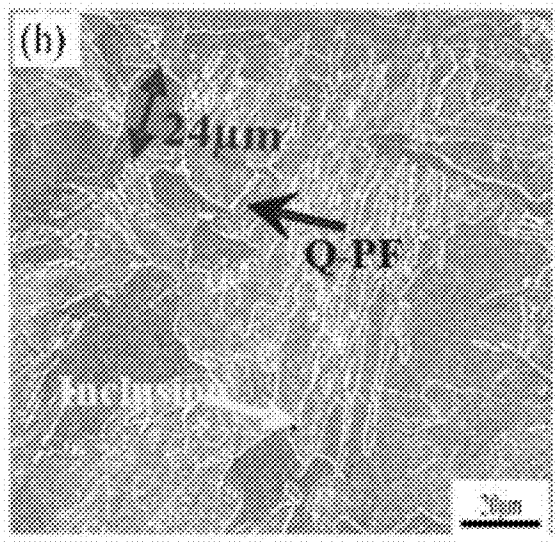
Figure 6G:
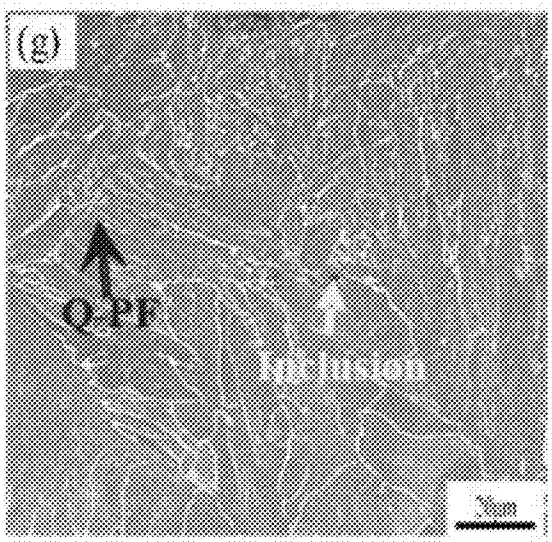

FIGS. 6A, 6B, 6C, 6D, 6E, 6F, 6G, 6H, 6I, 6J. 6K, and 6L are SEM images at different sites of the four samples. Samples S1-S3 contained no desirable phases for high hardness, but instead contained mainly either PF (e.g., in S2, as shown in FIGS. 6A, 6B, and 6C), or Q-PF (e.g., for S2 and S3, as shown in FIGS. 6D to 6I).

Figures 6J, 6K, 6L:
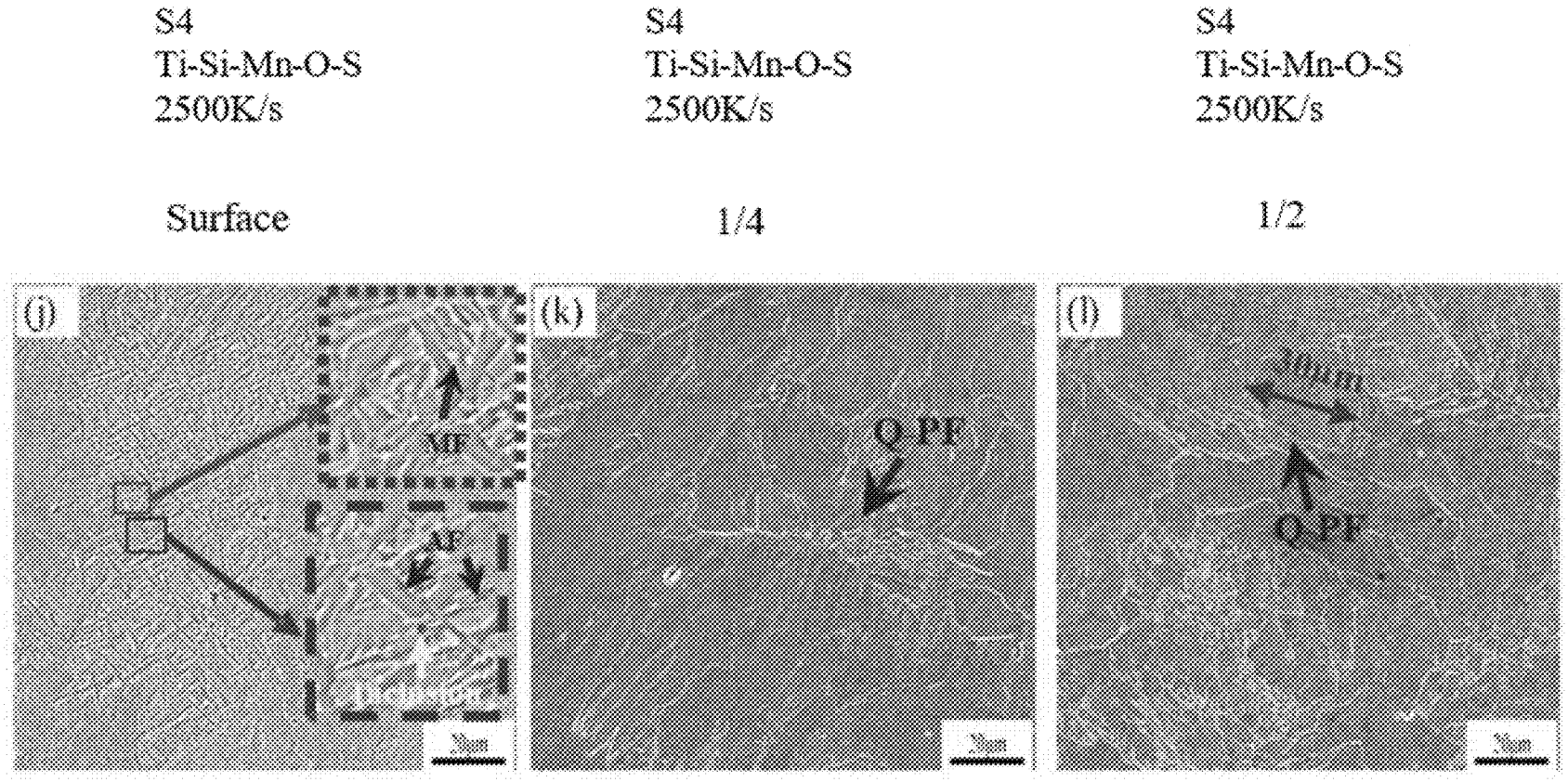

As shown in FIGS. 6A to L, typical microstructure at surface, at ¼ depth, and at ½ depth of all four samples. Acicular Ferrite (AF) nucleates on inclusions and has high angle grain boundaries, giving it high hardness. Martensite-like ferrite (MF) are other types of ultrafine grains with microstructure similar to that of martensite, which is known to be valuable for high hardness. Polygonal Ferrite (PF) and Quasi-Polygonal Ferrite (Q-PF) rank far below AF in hardness. As shown in FIGS. 6A to 6C, in S1 PF grains are 70 μm wide at the surface, 67 μm at ¼ depth, and 69 μm at ½ depth. As shown in FIGS. 6D to 6I, in S2 and S3 Q-PF grains are less than 30 μm in all three zones. As shown in FIGS. 6J to 6L, in S4 ultrafine AF and MF (0.5-1 μm wide) predominate at the surface, and small Q-PF grains (less than 30 μm) in the other two zones.

In S4, two kinds of microstructure were observed, one fine and one coarse. Because of the coupling effect of initial free oxygen content (i.e., 38 ppm) and cooling rate (i.e., 2500 K/s), maximum refinement was achieved between 0 and 200 μm from the surface. The fine grains (0.5-1 μm wide), which occurred only near the surface, were composed of a high volume % of AF and paralleled MF (e.g., as shown in FIG. 6J). Coarser grains, which occurred mainly in the other two zones (¼ and ½), were composed mainly of Q-PF (e.g., as shown in FIGS. 6K and 6L).

In some embodiments, PF and Q-PF nucleate mainly on austenite grain boundaries, while AF nucleates mainly on Ti-containing oxide inclusions within grains. The fact that only PF and Q-PF were found in S1 and S2 indicates that the inclusions present in those samples did not contribute to the refinement of the microstructure (e.g., as shown in FIGS. 6A to 6F).

Figure 7B:
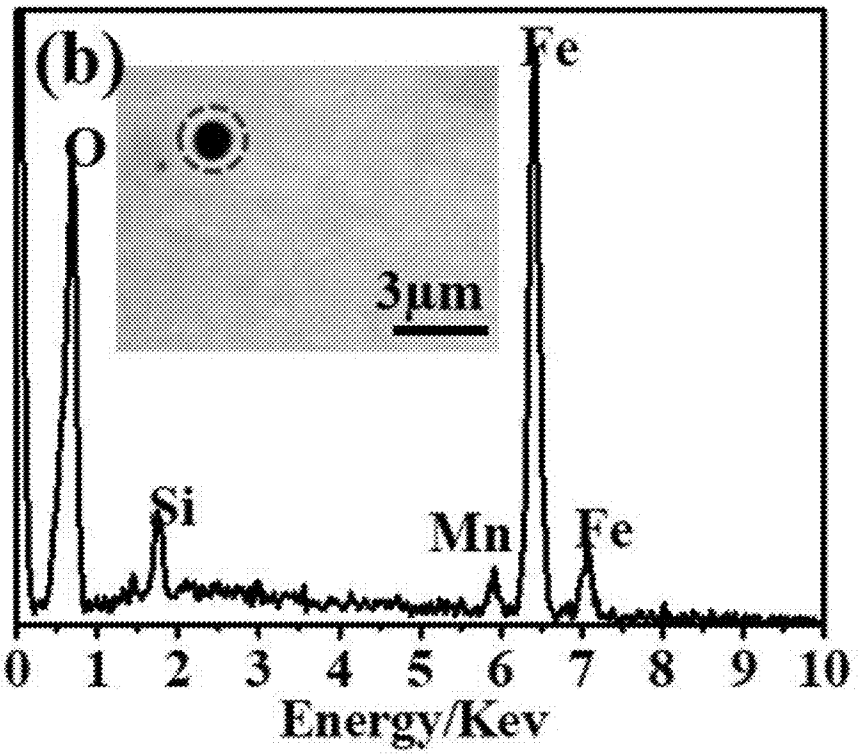
FIGS. 7A, 7B, 7C, and 7D are charts illustrating Energy Dispersive X-Ray Spectroscopy (EDS) of the four samples, and insets showing inclusions.
Figure 7A:
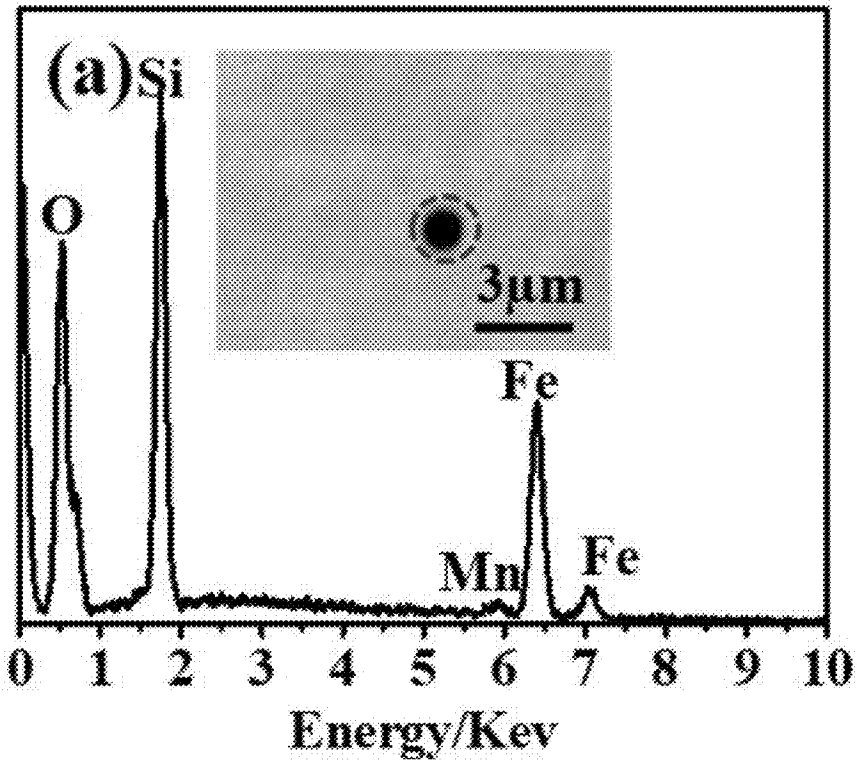
Figure 7C:
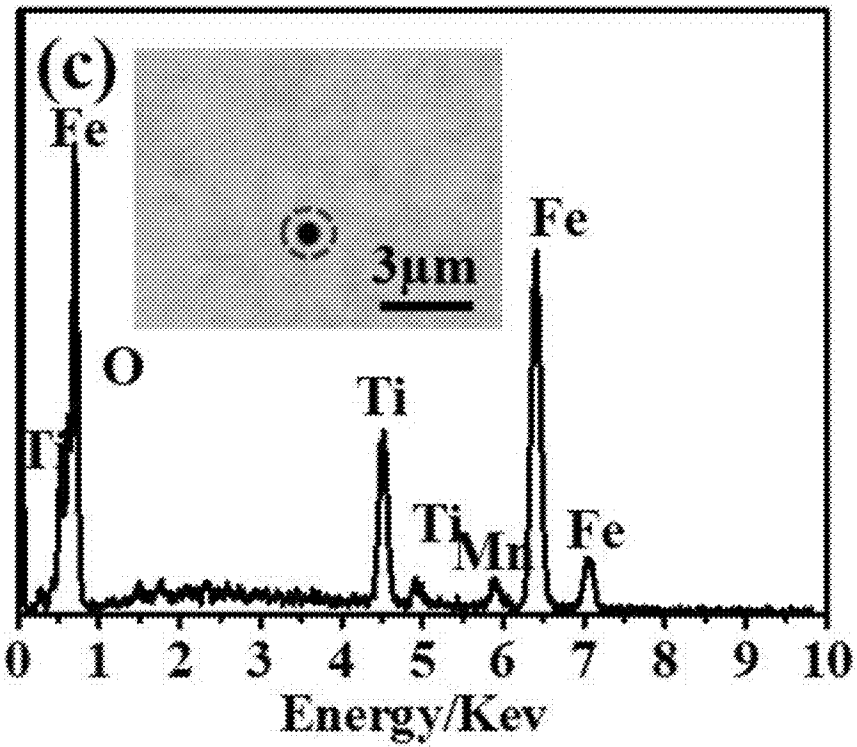
Figure 7D:
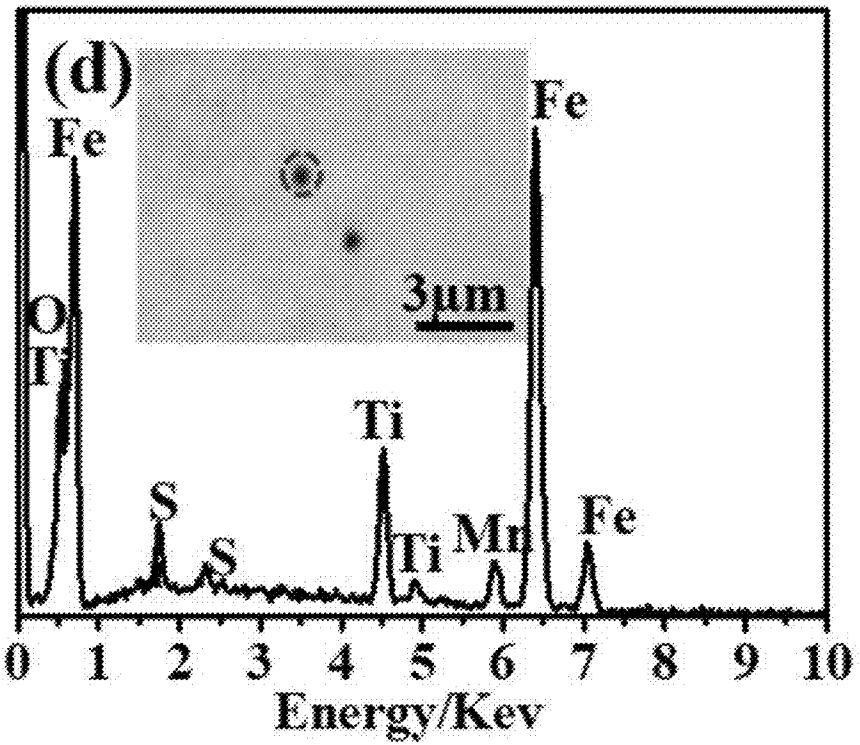

FIGS. 7A, 7B, 7C, and 7D are charts illustrating Energy Dispersive X-Ray Spectroscopy (EDS) of the four samples, and insets showing inclusions. This is because the inclusions in those samples were Mn—Si—O oxides rather than Ti-containing oxides (e.g., as shown in FIGS. 7A and 7B). Although Ti-containing oxides were detected in both S3 and S4 (e.g., as shown in FIGS. 7C and 7D), an appreciable volume % of AF occurred only in S4. Without being bound by theory, only in S4 did the number and size of Ti-containing oxides pass the critical threshold for the formation of AF. As shown in FIGS. 7A to 7D, morphology and chemical composition of typical inclusions observed in the four samples is shown: S1, Si—Mn—O (FIG. 7A); S2, Si—Mn—O (FIG. 7B); S3, Ti—Mn—O (FIG. 7C); S4, Ti—Si—Mn—O—S(FIG. 7D). The black dots in circles are the inclusions. The composition was analyzed by EDS.

Figure 8C:
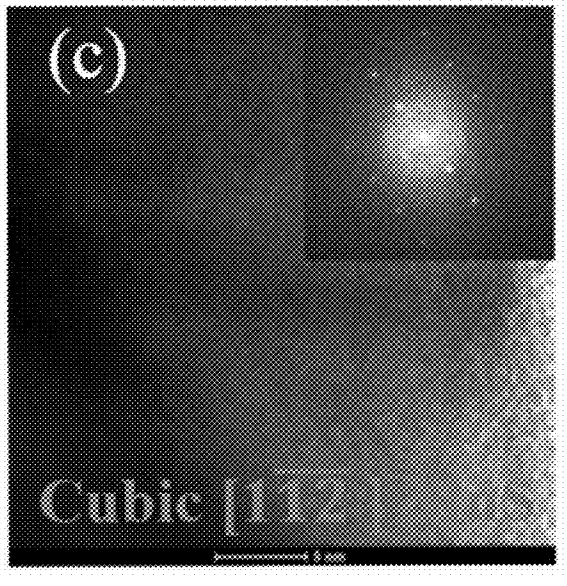
FIGS. 8B, 8C, 8D, 8E, and 8F are selected area diffraction pattern (SADP) images of selected areas from the sample of FIG. 8A.
Figure 8B:
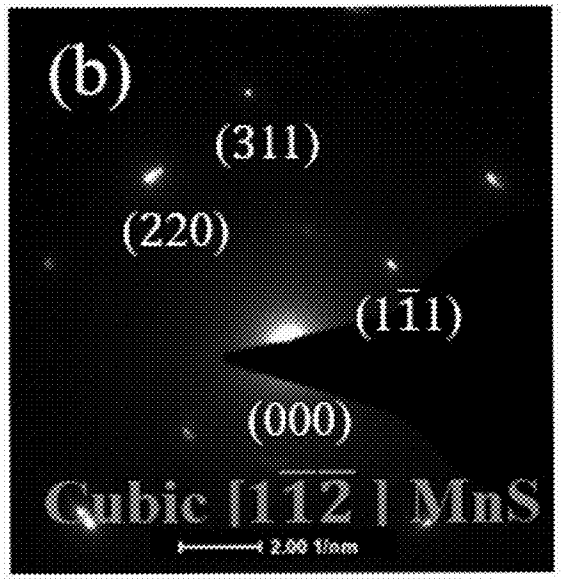
Figure 8A:
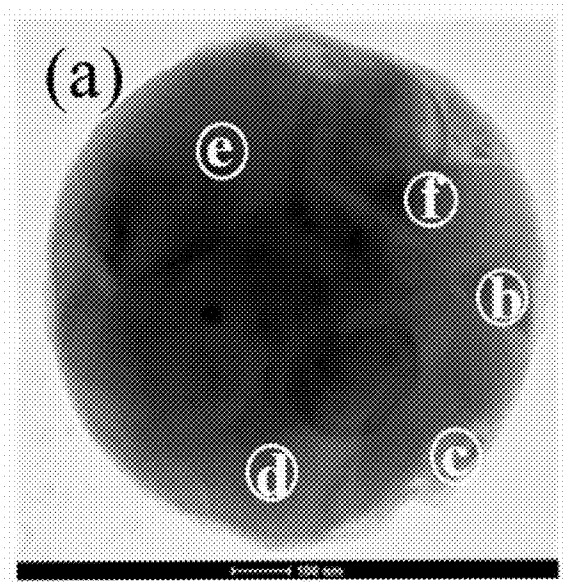
FIG. 8A is a transmission electron microscopy (TEM) image of a composite inclusion of one of the four samples.

FIG. 8A is a TEM image of a composite inclusion of one of the four samples. FIGS. 8B, 8C, 8D, 8E, and 8F are selected area diffraction pattern (SADP) images of selected areas from the sample of FIG. 8A. FIGS. 8G, 8H, 8I, 8J, 8K, and 8L are images showing EDS mapping analyzing of the inclusion of FIG. 8A.

Figure 8D:
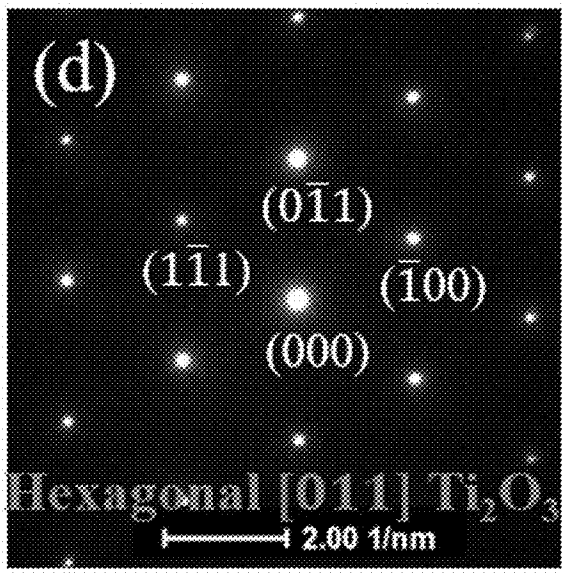
Figure 8E:
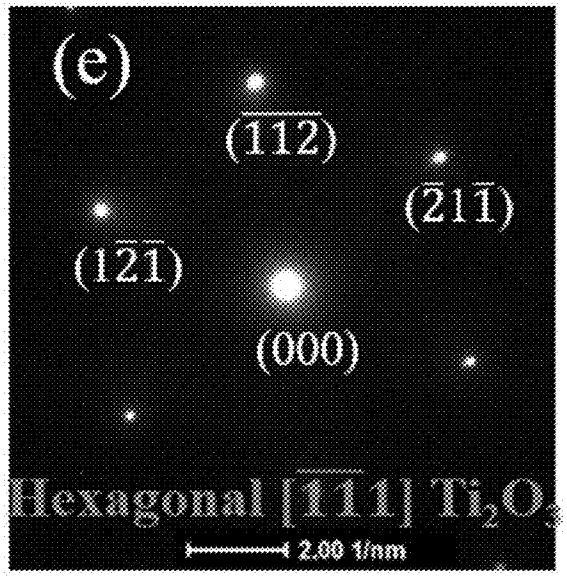
Figure 8F:
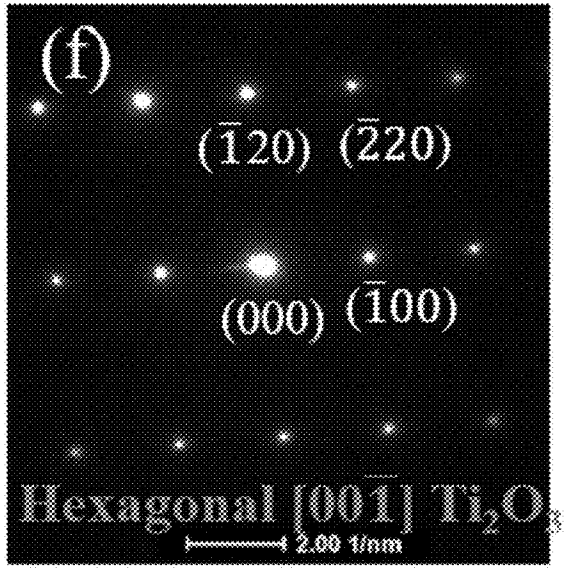
Figure 8G:
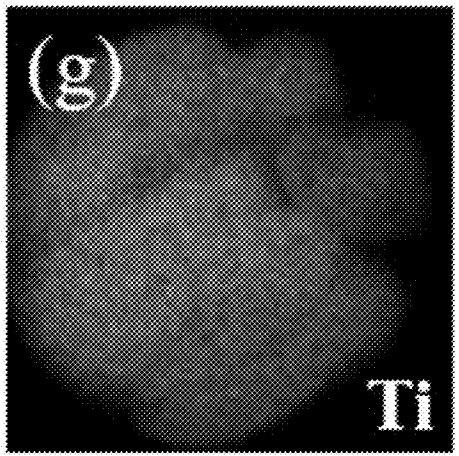
FIGS. 8G, 8H, 8I, 8J, 8K, and 8L are images showing EDS mapping analyzing of the inclusion of FIG. 8A.
Figure 8H:
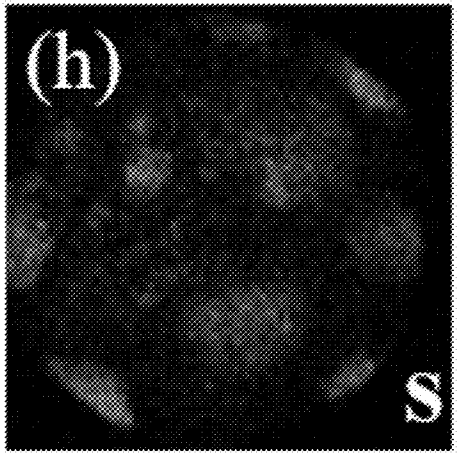
Figure 8I:
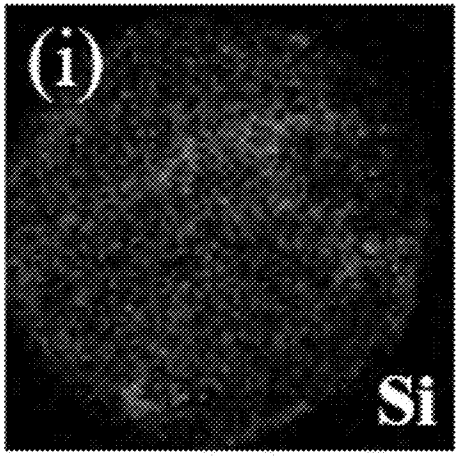
Figure 8J:
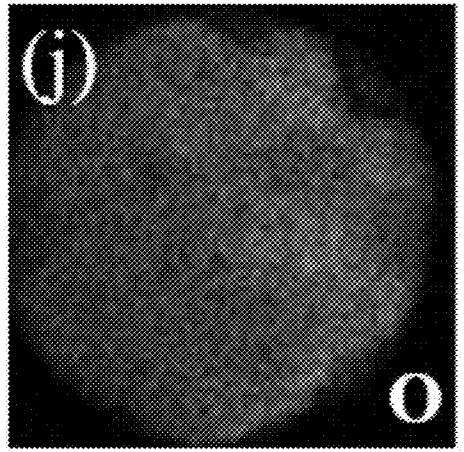
Figure 8K:
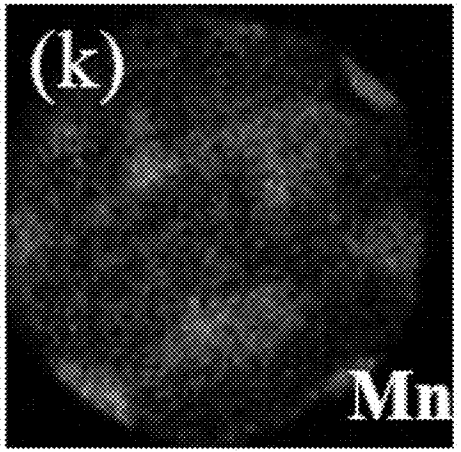
Figure 8L:
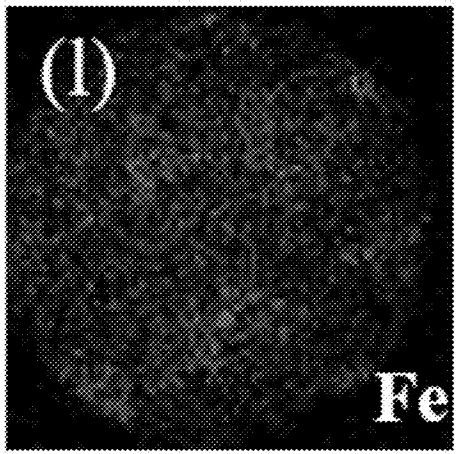

Typical oxide inclusion in S4 consisted of MnS and $Ti_2O_3$ (e.g., as shown in FIGS. 8A to 8L). The selected area diffraction pattern (SADP) revealed that MnS had cubic structure (e.g., as shown in FIGS. 8B and 8C) and $Ti_2O_3$ hexagonal structure (e.g., as shown in FIGS. 8D to 8F). Researchers have found that when $Ti_2O_3$ and MnS occur together, they tend to be especially effective for AF nucleation.

The composition of inclusions was more or less the same among the three zones of S4, but microstructure varied greatly from surface (where a high percentage of a mixture of AF and MF was detected) to center (where Q-PF was dominant).

Figure 9A:
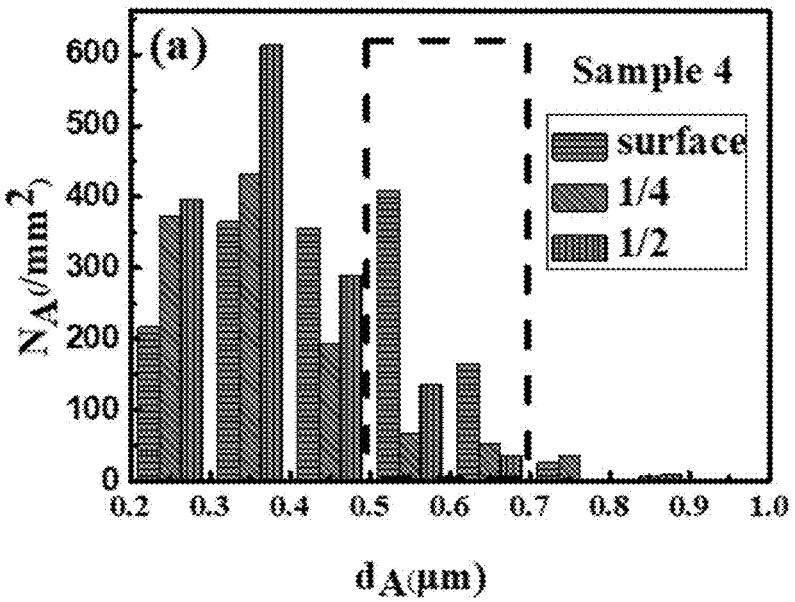
FIG. 9A is a chart illustrating the distribution of inclusions in one of the four samples.
Figure 9B:
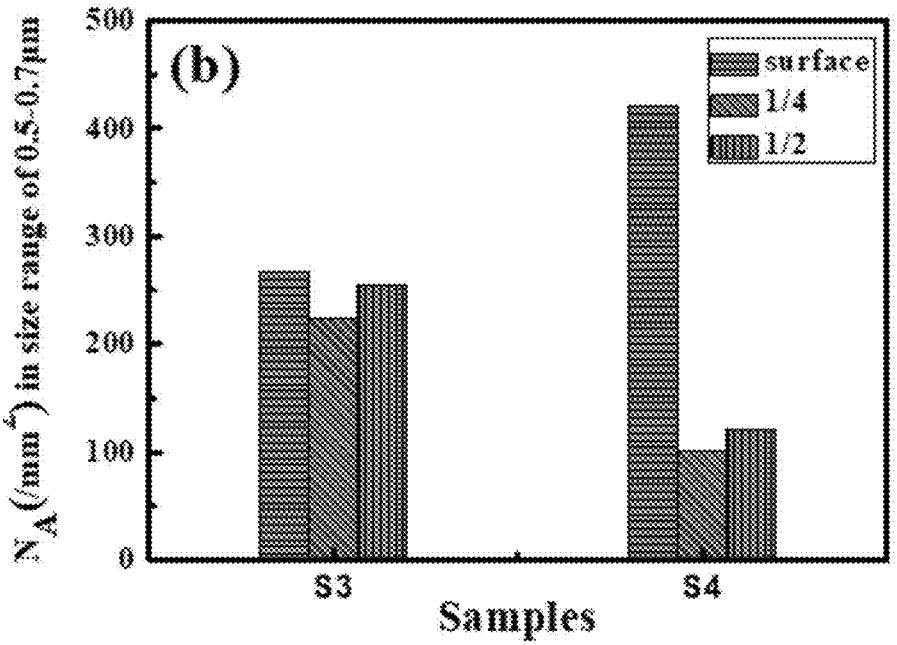
FIG. 9B is a chart illustrating a comparison of inclusion density of two different samples of the four samples.

The size distribution of inclusions was investigated to determine the effect of their size and density on the formation of AF. FIG. 9A is a chart illustrating the distribution of inclusions in one of the four samples. FIG. 9B is a chart illustrating a comparison of inclusion density of two different samples of the four samples. At the surface, the density of inclusions was higher in the 0.5-0.7 μm size range (about 600 per square millimeter) than at the other two depths of S4 (e.g., as shown in FIGS. 9A and 9B). All the inclusions located at the intersections of AF grain boundaries were in the size range of 0.5-0.7 μm. Without being bound by theory, 1) specific inclusions in the size range of 0.5-0.7 μm stimulated the nucleation of AF, and 2) when the density of such inclusions reached 600/mm$^2$, they contributed to a high volume % of AF.

As shown in FIG. 9A, distribution of inclusions in S4, inclusions ranging from 0.5 to 0.7 μm are more plentiful at the surface than at the other two zones. As shown in FIG. 9B, a comparison of S3 and S4, inclusion density in the size range of 0.5-0.7 μm is significantly higher at the surface of S4 than in any other zone of either S3 or S4.

Figure 10A:
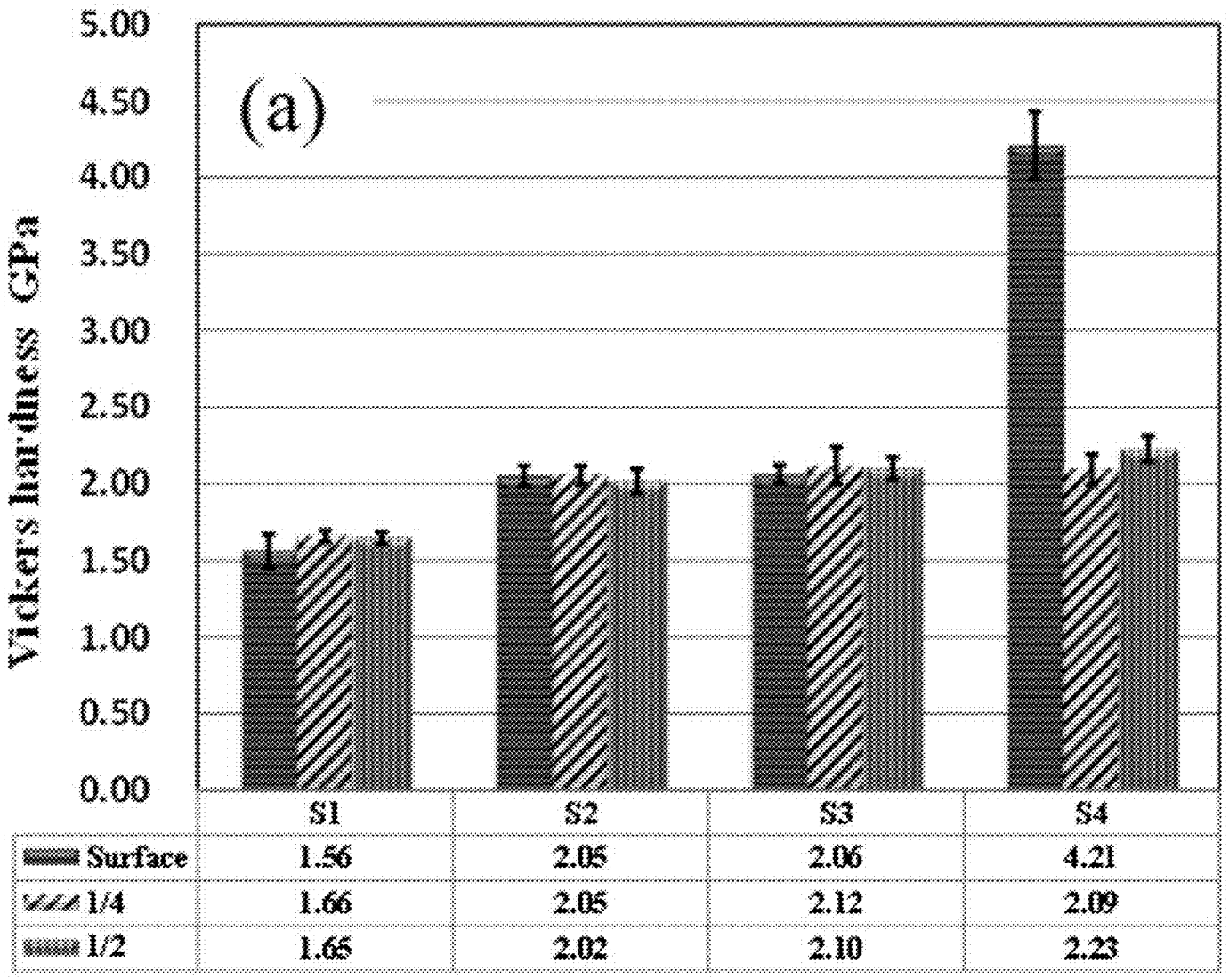
FIG. 10A is a chart illustrating the distribution of Vickers hardness at different sites of the four samples.
Figure 10B:
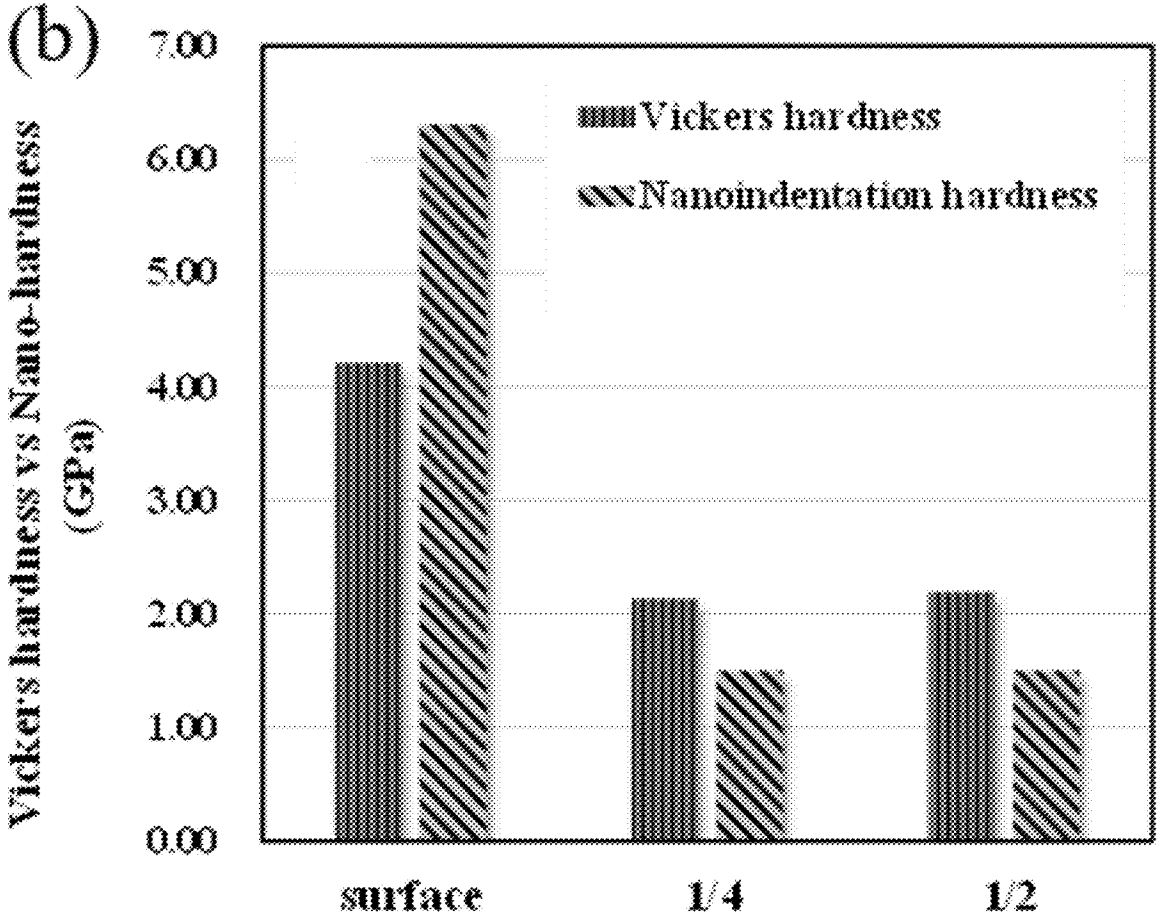
FIG. 10B is a chart illustrating a comparison of Vickers and nanoindentation hardness for the four samples.

FIG. 10A illustrates the distribution of Vickers hardness at different sites of the four samples. FIG. 10B illustrates a comparison of Vickers and nanoindentation hardness for the four samples. Vickers hardness values were low in S1, S2, and S3 (from about 1.6 GPa to about 2.1 GPa). In S4, however, values were low only at ¼ depth and ½ depth but rose to 4.2 GPa at surface (e.g., as shown in FIG. 10A). That value would be an incredibly high goal in the production of any low-carbon steel. Moreover, this high value was achieved without adding the costly steps of hot-rolling, cold-rolling, and quenching—the customary procedures for enhancing hardness and strength in steel production.

Variations in hardness can be explained by differences in the microstructure of the four samples. Hardness increases with decreasing grain size. Without being bound by theory, when grain size is finer, then external force can be dispersed through more grains, resulting in reduced plastic deformation. The size of the PF grains in S1 (the sample with the lowest hardness value) was greater than that of the Q-PF grains in S2, in S3, and in the ¼ and ½ depth zones of S4 (e.g., as shown in FIG. 10A). By contrast, the microstructure in the surface zone of S4, which contained both AF and MF, was superfine, thus providing the exceptionally high hardness of that zone.

FIG. 10A shows Vickers hardness in each zone of the four samples, and FIG. 10B shows Vickers hardness versus nanoindentation hardness of S4.

Because the difference in hardness between different areas is difficult to identify, T-test was performed to quantify the significant of the difference between different measurements. T-test results indicated significant differences in hardness between S1 and S2 and between S1 and S4, but the difference between S2 and S3 was insignificant (e.g., as shown in TABLE 2). The differences were significant between surface and ¼ and between surface and ½ in S4 (e.g., as shown in TABLE 3), but the differences were insignificant between surface and ¼ and between surface and ½ in S1, S2, and S3.

TABLE 2

P-value for significance analysis of hardness between different samples

| | S1 vs S2 | S2 vs S3 | S1 vs S4 |
|---|---|---|---|
| Surface | 0.01 | 0.68 | 0 |
| ¼ | 0 | 0.30 | 0 |
| ½ | 0 | 0.12 | 0 |

When P≤0.01, the difference in hardness is significant; otherwise, it is not significant.

TABLE 3

P-value for significance analysis of hardness between different parts of sample

| | Surface vs. ¼ | surface vs. ½ |
|---|---|---|
| S1 | 0.02 | 0.08 |
| S2 | 0.96 | 0.39 |
| S3 | 0.37 | 0.24 |
| S4 | 0 | 0 |

When P≤0.01, the difference in hardness is significant; otherwise, it is not significant.

Nanoindentation hardness is usually higher than Vickers (microindentation) hardness. In the surface zone of S4, this was indeed true, but in the ¼ and ½ depth zones of S4, nanoindentation hardness was actually slightly lower (e.g., as shown in FIG. 10B). The deformation zone during a Vickers hardness test is assumed to be 3 times the width of the microindentation. In our test, this width was 20 μm, so the deformation zone was about 60 μm on either side, or 120 μm in all. This is not only larger than the sample's grain size but also larger than its primary arm spacing (e.g., as shown in FIGS. 2A, 2B, and 6A to 6L). Thus, at the ¼ and ½ depth zones of S4, grain boundaries resisted deformation in the Vickers test, but not in the nanoindentation test. Since our nanoindentation tests were always performed inside grains, grain boundaries did not affect tests done at the ¼ and ½ depths of S4, where grain size was larger than at the surface. Consequently, nanoindentation values were lower at the ¼ and ½ depths. At the surface, however, because grain size was so fine that grain boundaries were necessarily involved regardless of the size of the indenter, the values for the nanoindentation test were higher, as expected.

Figure 11A:
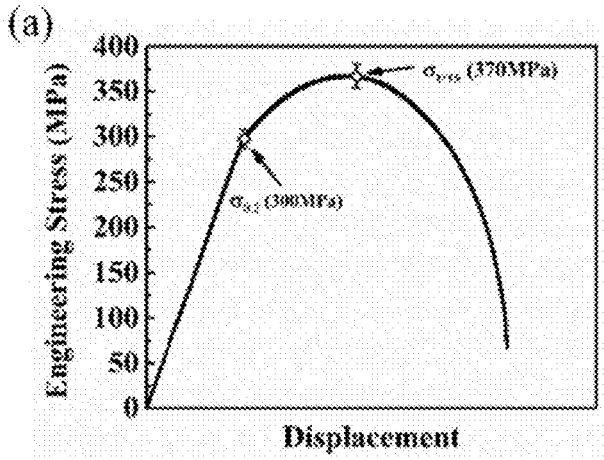
FIG. 11A is a chart illustrating an engineering stress-strain curve of one of the four samples.
Figure 11B:
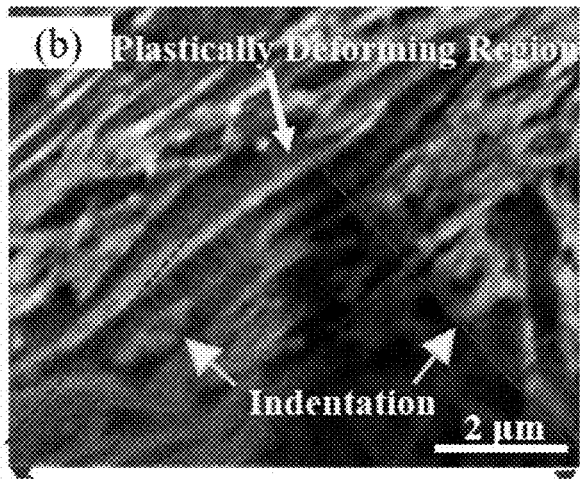
FIGS. 11B, 11C, and 11D are SEM images showing the structure of test indentations on one of the four samples.
Figure 11C:
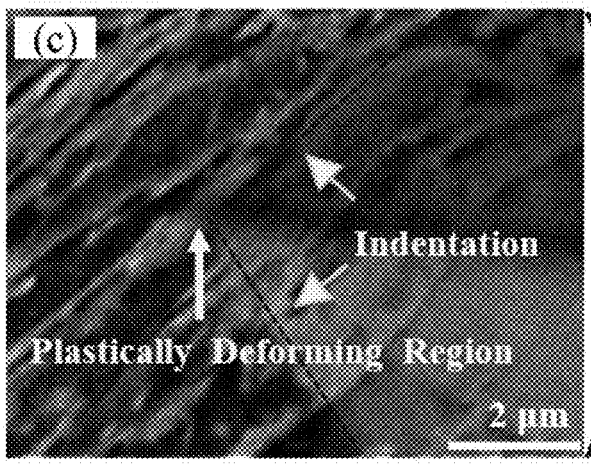
Figure 11D:
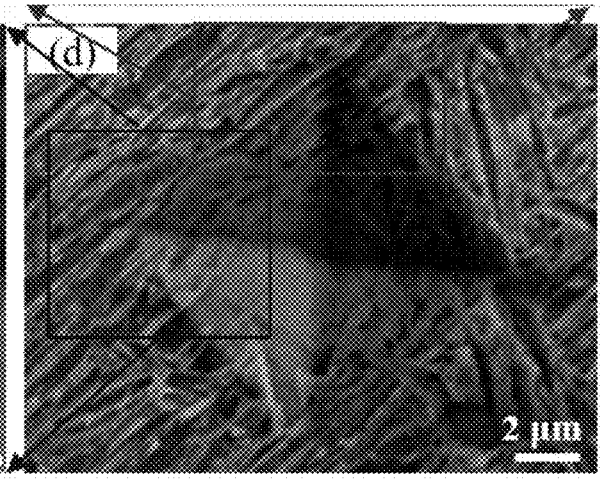

FIG. 11A illustrates an engineering stress-strain curve of one of the four samples. FIGS. 11B, 11C, and 11D are SEM images showing the structure of test indentations on one of the four samples. The Vickers hardness in the surface zone of S4 reached 4.2 GPa. Yield strength and ultimate tensile strength of S4 were 300±11 MPa and 370±14 MPa, respectively (e.g., as shown in FIG. 11A). Close examination of the indentation produced in the Vickers hardness test revealed no cracks (e.g., as shown in FIGS. 11B and 11C). The edge of the indentation shows entire ductile deformation. This, along with the absence of cracks, indicates that the fracture toughness of the fine-grained region at the surface of S4 was very high.

Hardness and yield strength are closely related each other. They both measure the onset of plastic deformation. Yield strength in the surface zone of S4 can be related to Vickers hardness according to EQUATION 4.

$$H0=4.15\sigma y \qquad \text{(Equation 4)}$$

σy is yield strength and H0 is hardness.

The coefficient (4.15) is very close to data previously obtained in research on pearlitic steels. The yield strength value in the surface zone of S4 was calculated at >1.0 GPa, which was 2 times as high as that of the other samples.

Mechanical properties of S4 and SEM images of a typical Vickers hardness indentation at the surface of S4 are shown in FIGS. 11A to 11D. For example, FIG. 11A shows engineering stress-strain curve of S4. FIGS. 11B and 11C show partial enlargement of the indentation diagonal in (d) showing entire ductile deformation. FIG. 11D shows SEM image of Vickers hardness indentation (200 μm from the surface of S4).

While the disclosure has been described with reference to a number of embodiments, it will be understood by those skilled in the art that the invention is not limited to such disclosed embodiments. Rather, the invention can be modified to incorporate any number of variations, alterations, substitutions, or equivalent arrangements not described herein, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We claim:

1. A method for making a low-carbon steel, the method comprising:

heating a low-carbon steel precursor material in a furnace to form molten steel material;

increasing the free oxygen content of the molten steel material to a predetermined level from 25 ppm to 45 ppm; and then solidifying the molten steel material having the predetermined oxygen level to produce a low-carbon steel structure by cooling the molten steel material at a predetermined cooling rate, wherein the low-carbon steel structure has a surface hardness of at least 4.0 GPa Vickers immediately after cooling, and wherein the predetermined cooling rate is at least 2500 K/s.

2. The method of claim 1, wherein the low-carbon steel structure has a surface hardness of at least 4.2 GPa Vickers immediately after cooling.

3. The method of claim 1, wherein the low-carbon steel structure comprises inclusions smaller than about 1 μm.

4. The method of claim 3, wherein the inclusions have sizes in a range from 0.5 to 0.7 μm.

5. The method of claim 3, wherein the inclusions are present in the low-carbon steel in an area density up to 600 per $mm^2$.

6. The method of claim 3, wherein the inclusions comprise multiple-component, Ti-containing oxides.

7. The method of claim 1, wherein increasing the free oxygen content comprises adding FeO to the molten steel material.

8. The method of claim 7, wherein the FeO is added in an amount effective to increase the free oxygen content to 38 ppm.

9. The method of claim 7 further comprising adding to the molten steel material one or more of a Ferromanganese (FeMn) alloy, a Si Ferrosilicon (FeSi) alloy, or a Ti Ferrotitanium (FeTi) alloy.

10. A method for making a steel structure, the method comprising:

heating a low-carbon steel precursor material in a furnace to form molten steel material;

adding FeO to the molten steel material in an amount effective to produce a predetermined level of free oxygen content of between 25 ppm and 45 ppm; and adding one or more of FeTi, FeMn, or FeSi to the molten steel material in an amount effective to produce nucleation sites for acicular ferrite in an area density up to 600 per $mm^2$; and then solidifying the molten steel material to produce the steel structure by cooling the molten steel material at a predetermined cooling rate effective to produce inclusions smaller than about 1 μm, wherein the predetermined cooling rate is greater than or equal to 2500 K/s, and wherein the steel structure has a surface hardness of at least 4.0 GPa Vickers immediately after cooling.

11. The method of claim 10, wherein the steel structure is a sheet.

12. The method of claim 10, wherein the steel structure comprises an ultrahard surface layer.

13. A method for making a low-carbon steel, the method comprising:

heating a low-carbon steel precursor material in a furnace to form molten steel material;

adding to the molten steel material one or more of a Ferromanganese (FeMn) alloy, a Si Ferrosilicon (FeSi) alloy, or a Ti Ferrotitanium (FeTi) alloy;

increasing the free oxygen content of the molten steel material to a predetermined level from 25 ppm to 45 ppm; and then solidifying the molten steel material having the predetermined oxygen level to produce a steel structure by cooling the molten steel material at a predetermined cooling rate, wherein the steel structure has a surface hardness of at least 4.0 GPa Vickers immediately after cooling, wherein the predetermined cooling rate is greater than or equal to 2500 K/s, wherein the steel structure comprises inclusions smaller than 1 μm, and wherein the inclusions are present in the steel structure in an area density up to 600 per $mm^2$.

* * * * *